US006960723B2

(12) United States Patent
Fujii et al.

(10) Patent No.: US 6,960,723 B2
(45) Date of Patent: Nov. 1, 2005

(54) TERMINAL FITTING

(75) Inventors: Masayasu Fujii, Yokkaichi (JP); Toshikazu Sakurai, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/646,996

(22) Filed: Aug. 22, 2003

(65) Prior Publication Data

US 2004/0040734 A1 Mar. 4, 2004

(30) Foreign Application Priority Data

Aug. 22, 2002 (JP) ..... 2002-242335
Oct. 21, 2002 (JP) ..... 2002-305684

(51) Int. Cl.[7] ..... H01R 15/32
(52) U.S. Cl. ..... 174/84 C
(58) Field of Search ..... 174/84 C, 74 R; 439/287, 883, 889, 907, 877

(56) References Cited

U.S. PATENT DOCUMENTS 3,262,088 A * 7/1966 West ..... 439/849
4,371,230 A * 2/1983 Inoue ..... 439/849
4,832,620 A * 5/1989 Yamamoto ..... 439/422
6,530,795 B2 3/2003 Maeda et al.
6,670,555 B2 * 12/2003 Ota et al. ..... 174/135

FOREIGN PATENT DOCUMENTS

JP 8-236184 9/1996

* cited by examiner

*Primary Examiner*—Chau N. Nguyen
(74) *Attorney, Agent, or Firm*—Gerald E. Hespos; Anthony J. Casella

(57) ABSTRACT

A terminal fitting (10) is made of a metallic plate material stamped out into a specified shape and has a substantially flat main body (13), a substantially flat coupling (16) extending from an outer peripheral edge of the main body (13), and a wire crimping portion (17) further extending from an extending end of the coupling (16). The coupling (16) of the terminal fitting (10) has a reinforcement formed by placing reinforcing plates (20, 26) substantially one over the other.

20 Claims, 21 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 8-236184 and FIG. 10 herein show a known grounding terminal fitting. With reference to FIG. 10, the grounding terminal fitting is formed by bending a metallic plate stamped out into a specified shape and having a specified thickness. The grounding terminal fitting of FIG. 10 has a flat main body 1101 and a wire crimping portion 1102 formed at the leading end of a portion that extends from the outer peripheral edge of the main body 1101. The wire crimping portion 1102 defines an open barrel and has a bottom wall that extends continuously from the main body 1101 and two crimping pieces 1104 that extend up from the opposite lateral edges of the bottom wall 1103. A wire (not shown) is placed on the bottom wall 1103 and the crimping pieces 1104 are deformed plastically to wrap around the wire. Thus, the wire crimping portion 1102 is crimped into connection with the wire. A coupling 1105 couples the terminal main body 1101 and the wire crimping portion 1102.

There have been demands in recent years to provide wiring harnesses with wires that have a smaller diameter. Wires to be connected with grounding terminal fittings are no exception. However, the grounding terminal fitting with the above-described wire crimping portion 1102 has a problem when the diameter of the wire is reduced. In particular, the crimping pieces 1104 are more difficult to bend as the relative thickness thereof increases. Thus, the minimum diameter of the wires to be connected is restricted by the relative thickness of the crimping pieces 1104. Fastening forces of the crimping pieces 1104 to the wire are reduced if the wire is too thin relative to the thickness of the crimping pieces 1104 and contact reliability of the grounding terminal fitting and the wire is reduced.

The thickness of the grounding terminal fitting may be reduced to meet the demand for thinner wires. However, a reduced thickness also reduces the strength of the grounding terminal fitting. The grounding terminal fitting normally is handled without being in a housing. Thus, a thin grounding terminal fitting can be deformed or broken by another member. Specifically, stress is likely to concentrate on the coupling 1105 that couples the main body 1101 and the wire crimping portion 1102, and the coupling 1105 is likely to deform or brake.

The present invention was developed in view of the above problem and an object thereof is to provide a terminal fitting which has a sufficient strength.

SUMMARY OF THE INVENTION

The invention is a terminal fitting, such as a grounding terminal fitting, made of a conductive plate material stamped or cut out into a specified shape. The terminal fitting has a main body that preferably is substantially flat. A coupling extends from an outer peripheral edge of the main body, and a wire connection portion extends from an extending end of the coupling. The coupling comprises at least one reinforcing means formed by folding one or more reinforcing plates. As a result, a portion that is likely to be deformed and broken can have sufficient strength even if the conductive plate is thinned to facilitate bending. In particular, the thinner plate material enables the wire connection portion to be bent more easily, whereas a sufficient strength is secured by folding the reinforcing plates at the coupling between the main body and the wire connection portion. Accordingly, each part of the terminal fitting can have a suitable thickness. For example, a grounding terminal fitting can have a sufficiently strong coupling between a main body and a wire crimping portion even if the conductive plate material is thin.

The terminal fitting can be a first terminal fitting assembled with a second terminal fitting that has a substantially flat second main body and a second lock that extends up from an outer peripheral edge of the second main body by a distance substantially equal to the thickness of the first main body. The first main body may have a layered structure by folding a single plate substantially continuous with the reinforcing plates, thereby having the same thickness as the second main body. The layered first main body may be formed with at least one lock that stands up from the outer peripheral edge of the first main body by substantially the same distance as the second lock. The second main body may be held between the first main body and the first lock and/or the first main body may be held between the second main body and the second lock.

The terminal fittings can be assembled by being placed substantially one over the other. Additionally, a terminal fitting having single-plate main body can be assembled with a terminal fitting having a layered main body, thereby making it possible to assemble a plurality of terminal fittings formed of plate materials having different thicknesses. More specifically, the above-described first terminal fitting made of a thinner plate may be crimped into connection with a thinner wire and a second terminal fitting made of a thicker plate may be crimped, bent or folded into connection with a thicker wire,. The first main body can be layered to equal the thickness of the second main body so that these two terminal fittings can be assembled with each other.

The reinforcing plate may be folded at lateral edges of the coupling. Accordingly, the reinforcing plates and the coupling are integral. Thus, the coupling can be reinforced with a single member and without a complicated construction The coupling preferably has side walls that stand up along lateral edges. Thus, the reinforcing effect is enhanced further by the sidewalls.

The coupling side walls and the reinforcing plates preferably are substantially continuous with each other along the lateral edges of the coupling. Thus, a sufficient strength can be secured at boundaries between the side walls and the reinforcing plates. Accordingly, deformation and breaking can be avoided even at the boundaries where stresses are likely to concentrate.

The wire connection portion preferably is a barrel with a bottom plate that is substantially continuous with the coupling and crimping pieces that stand up from lateral edges of the bottom plate. The crimping pieces and the side walls are substantially continuous with each other along the lateral edges of the coupling. Thus, the boundaries between the sidewalls and the crimping pieces can be reinforced continuously and can have a higher strength.

The coupling preferably is formed with at least one narrow reinforcement rib extending substantially along the extending direction of the coupling. The reinforcement rib may be formed by embossing, and hence provides a simple enhancement to the reinforcing effect.

At least one flat reinforcing plate may be placed on the coupling. The coupling and/or the reinforcing plate may have displacement preventing means for preventing displacements of the coupling and the reinforcing plate along a thickness direction and/or along planar directions of the facing surfaces thereof. The reinforcing plate enhances the strength of the coupling and enables the terminal fitting to be formed from a thin material to accommodate a thinner wire.

Reinforcement by the reinforcing plate is insufficient if the reinforcing plate and the coupling can be separated along a thickness direction or displaced in planar directions. More particularly, strength is given only by the coupling if the reinforcing plate can move relative to the coupling. However, the coupling and the reinforcing plate of the subject invention have the displacement preventing means for securely placing the reinforcing plate on the coupling. Thus, reinforcement of the coupling by the reinforcing plate is be secured.

The displacement preventing means may include an engaging hole and an engaging projection. The engaging hole may be in the reinforcing plate or in a portion of the coupling where the reinforcing plate is placed on the coupling.

The engaging projection is formed on the other of the coupling and the reinforcing plate, and preferably is formed by embossing. The engaging projection projects to a side where the coupling and the reinforcing plate contact each other. Additionally, the engaging projection is engageable with the engaging hole.

The engaging projection preferably has a height longer than the depth of the engaging hole. Thus, the leading end of the engaging projection projects out from the engaging hole and is pressed into close contact with an opening edge of the engaging hole. As a result, the engaging projection cannot come out of the engaging hole and separation of the coupling and the reinforcing plate along a thickness direction can be prevented. Further, displacements of the reinforcing plate and coupling along planar directions also can be prevented.

The displacement preventing means may include at least one cut and at least one fastener. The cut may be at an edge of the coupling or the reinforcing plate and has two edges substantially facing each other along a longitudinal direction. The fastener is on the other of the coupling and the reinforcing plate and is crimped into close contact with a surface of the coupling or the reinforcing plate adjacent the cut to hold the coupling and the reinforcing plate together.

Opposite edges of the cut and those of the fastener contact each other when the fastener is crimped. Accordingly, the fastener and the cut are caught, and displacements of the coupling and the reinforcing plate are prevented.

The coupling, the reinforcing plate and the fastener define a triple-layered structure to enhance strength and to prevent the coupling and the reinforcing plate from being separated along the thickness direction.

The invention may further comprise two terminal fittings that can be assembled together. The terminal fittings are placed at an initial assembling position, but are moved relative to one another to a proper assembling position. Return preventing means are provided in the main bodies of the two terminal fittings and may be in the form of a projection and a recess. The return preventing means engage to hold the terminal fittings in the proper assembling position.

The return preventing means may include a return preventing hole in one terminal fitting and a return preventing projection on the other terminal fitting. Each return preventing projection is formed by cutting and bending, and opposite ends of each return preventing projection are unitary with the main body. Thus, the return preventing projection is unlikely to be turned up. A cantilevered return preventing projection would have three sides separated from the main body, and a force on the free end could pull the free end up relatively easily, thereby impairing a locking function. However, opposite ends of the return preventing projection of the subject invention are coupled to the main body. Thus, the return preventing projection is unlikely to be turned up or otherwise deformed and can securely give a holding force when engaged with the return preventing hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
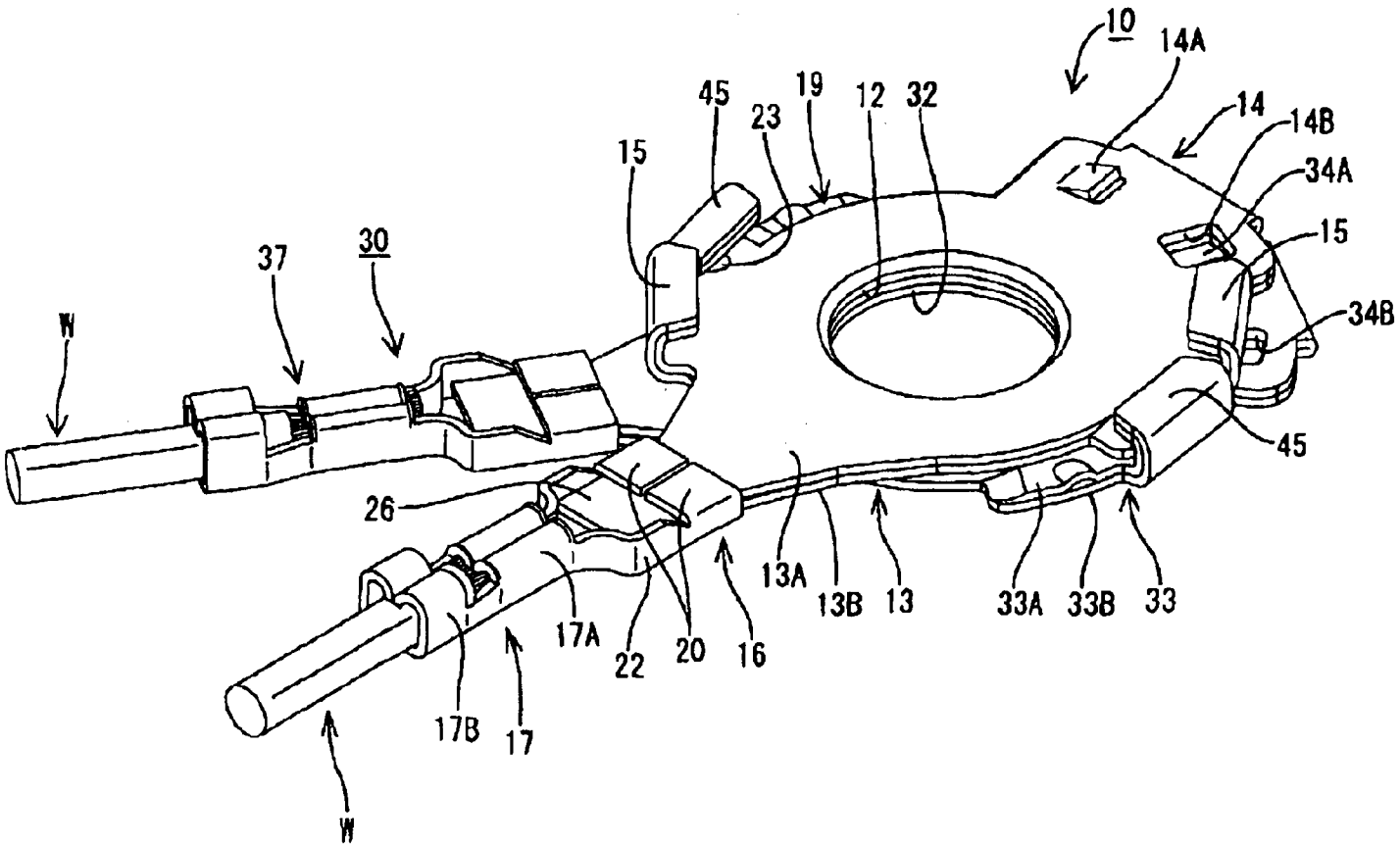
FIG. 1 is a perspective view showing a state where a grounding terminal fitting of a first embodiment is assembled with another grounding terminal fitting.
Figure 2:
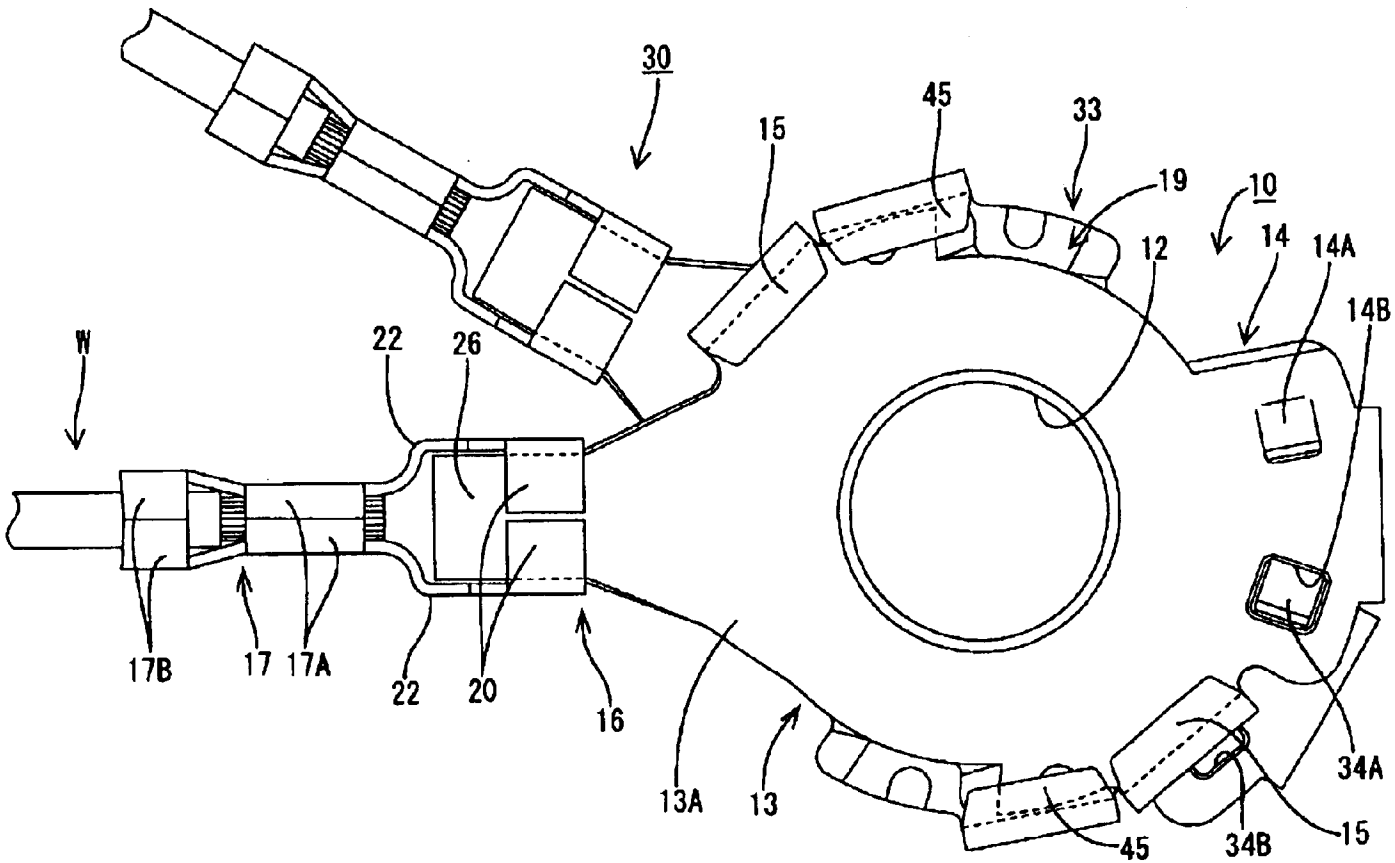
FIG. 2 is a plan view showing the state of FIG. 1.
Figure 3:
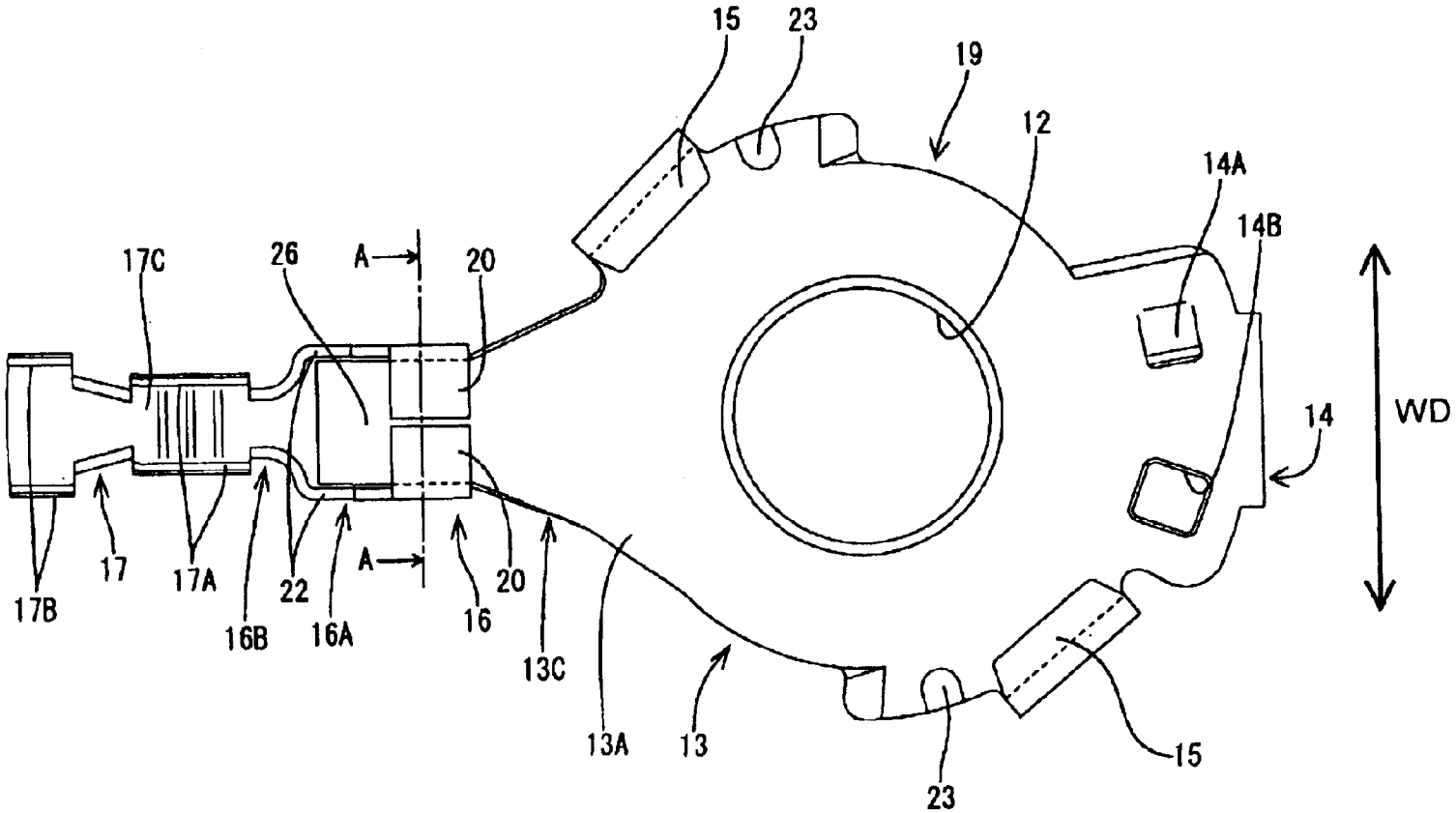
FIG. 3 is a plan view of the grounding terminal fitting of the first embodiment.

A grounding terminal according to a first embodiment of the invention is identified by the numeral 10 in FIGS. 1 to 7. As shown in FIG. 3, the grounding terminal fitting 10 is formed by bending, folding and/or embossing a conductive metallic plate stamped or cut into a specified shape. The grounding terminal 10 has a substantially flat main body 13 with a bolt hole 12 substantially in the center. A substantially flat coupling 16 extends from an outer peripheral edge of the main body 13, and a wire crimping barrel 17 extends from an end of the coupling 16. A side where the coupling 16 extends from the main body 13 is referred to as the back (left side in FIG. 3), a side opposite the coupling is referred to as the front (right side in FIG. 3), and a direction normal to forward and backward directions in a plane parallel with the plane of the main body 13 is referred to as the widthwise direction WD of the grounding terminal fitting 10. Further, the top of the grounding terminal fitting 10 is a side where a wire is to be placed (side shown in a plan view of FIG. 3), and the bottom is a side opposite the top.

Figure 7:
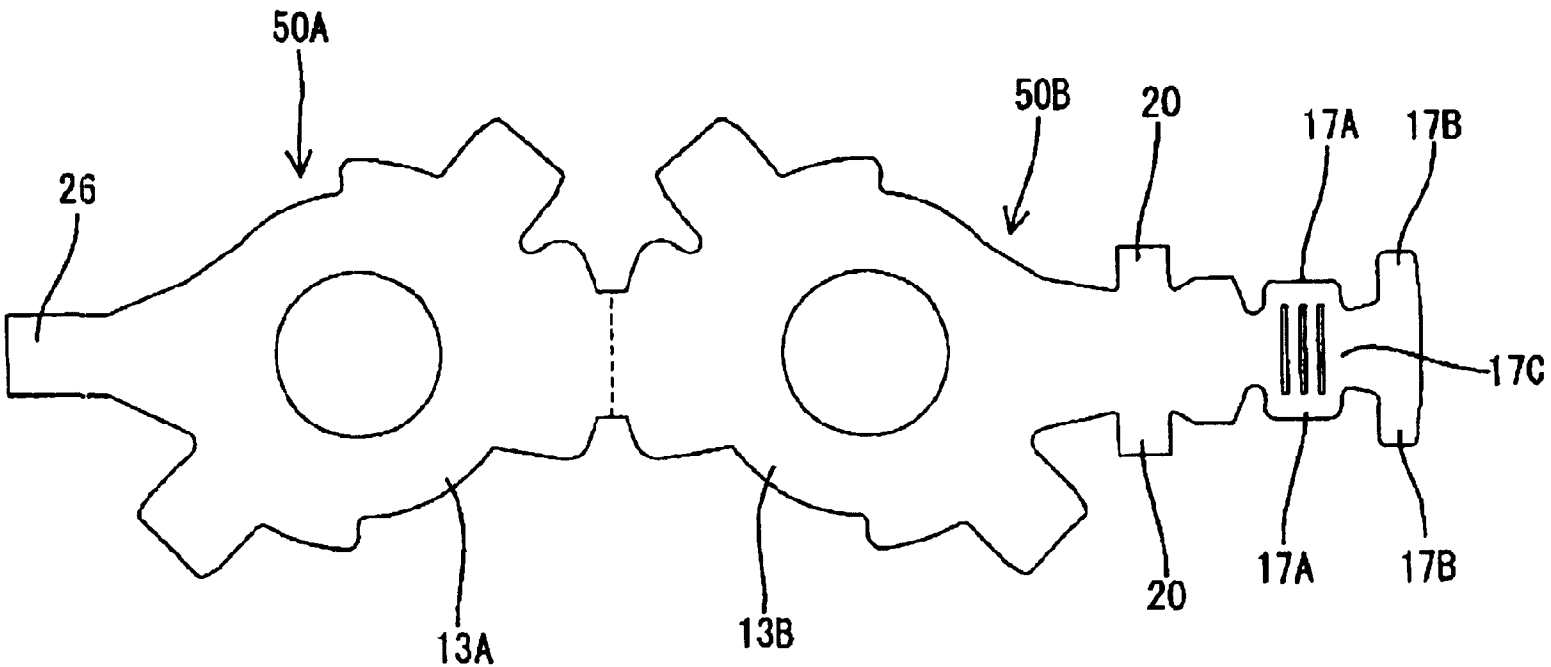
FIG. 7 is a diagram of a metallic plate material before being bent.

The main body 13 has a substantially flat shape, as shown in FIG. 3, with upper and lower plates 13A and 13B. More particularly, the grounding terminal fitting 10 is a layered structure formed from a unitary metallic plate that has a shape shown in FIG. 7. The metallic plate shown in FIG. 7 is folded along a folding line between first and second panels 50A and 50B. The first panel 50A is placed on the second panel 50B and forms the upper plate 13A of the main body 13.

The main body 13 has an annular portion 19 with an outer peripheral edge substantially concentric with the bolt hole 12, as shown in FIG. 3. A rotation preventing portion 14 projects from the outer peripheral edge of the annular portion 19 forward substantially flush with the annular portion 19. The rotation preventing portion 14 includes a rotating restricting piece 14A and a rotation preventing hole 14B. The rotation preventing piece 14A is insertable into a rotation preventing hole in another grounding terminal fitting, and the rotation preventing hole 14B receives the rotation preventing piece of the other grounding terminal fitting to prevent the rotation.

Figure 4:
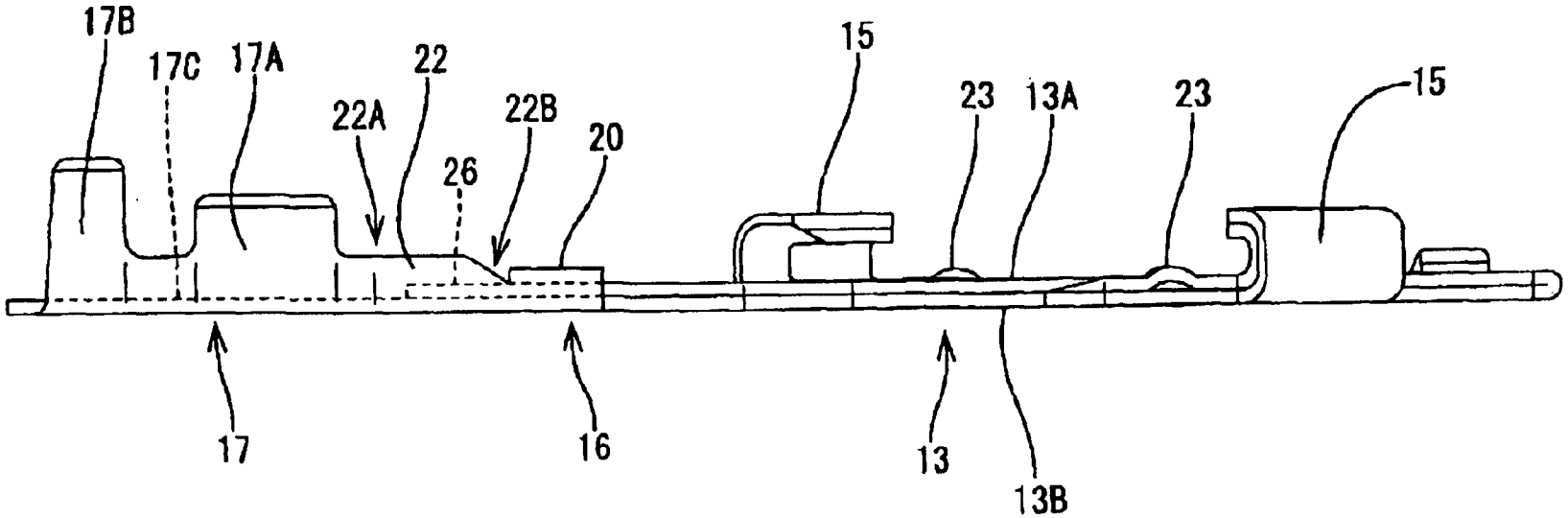
FIG. 4 is a side view of the grounding terminal fitting of the first embodiment.

Two locks 15 of inverted L-shape stand up from the outer peripheral edge of the annular portion 19 at substantially diametrically opposite sides of the bolt hole 12, as shown in FIGS. 3 and 4. Each lock 15 has a layered structure with a portion that stands up from the upper plate 13A of the main body 13 and a portion that stands up from the lower plate 13B. The portions that stand up from the lower plate 13B hold both the upper plate 13A and the portions of the respective lock 15 that stand-up from the upper plate 13A. Thus, movements of the upper plate 13A with respect to the lower plate 13B in the directions parallel with the top surface of the main body 13 are restricted.

Ends of the locks 15 are bent in toward the center of the bolt hole 12. More particularly, the portion of each lock 15 that extends from the lower plate 13B is bent in to hold the portion that extends from the upper plate 13A between the bends and the lower plate 13B. As a result, movements of the upper plate 13A relative to the lower plate 13B in directions normal to the plane of the main body 13 are restricted, and the upper and lower plates 13A and 13B define an integral layered structure. The rotation preventing portions 14 and the locks 15 can be formed by applying a specified working after folding the metallic plate material as shown in FIG. 7 to form the double-layered main body 13.

Figure 5:
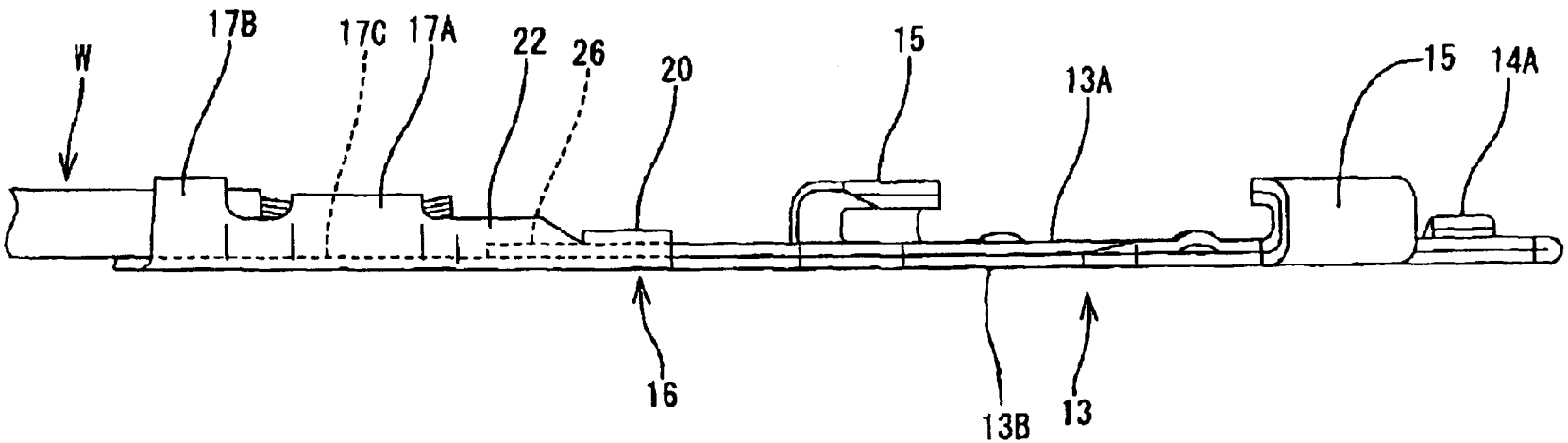
FIG. 5 is a side view showing a wire connected with the grounding terminal fitting of FIG. 4.
Figure 6A:
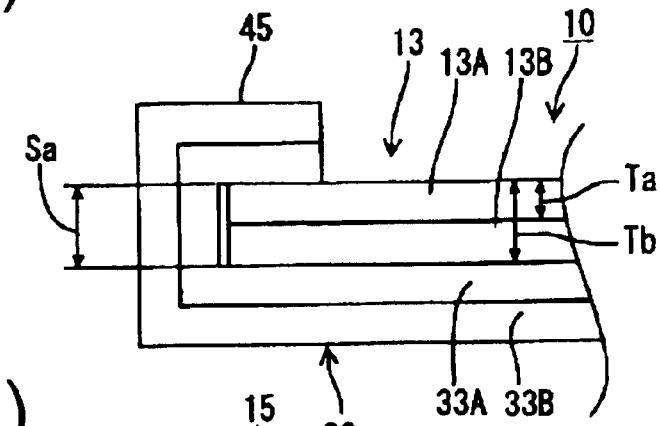
FIGS. 6(*a*) through 6(*d*) show locking structures of the grounding terminal of the first embodiment assembled with other grounding terminal fittings.
Figure 6B:
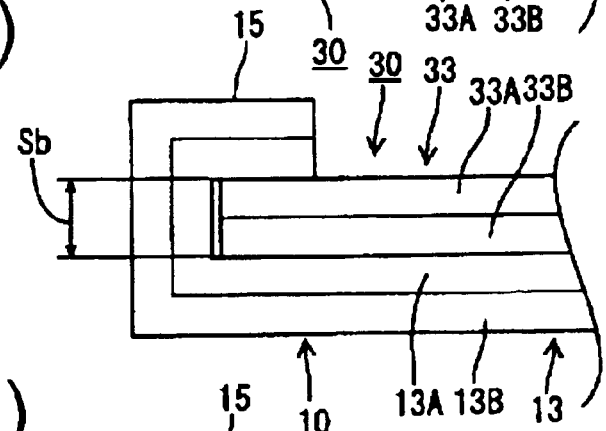
Figure 6C:
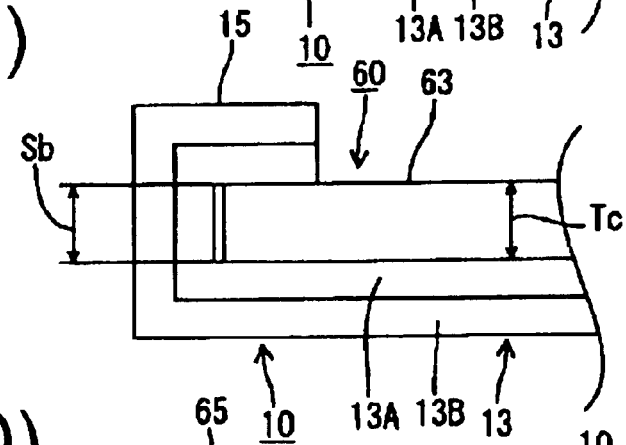
Figure 6D:
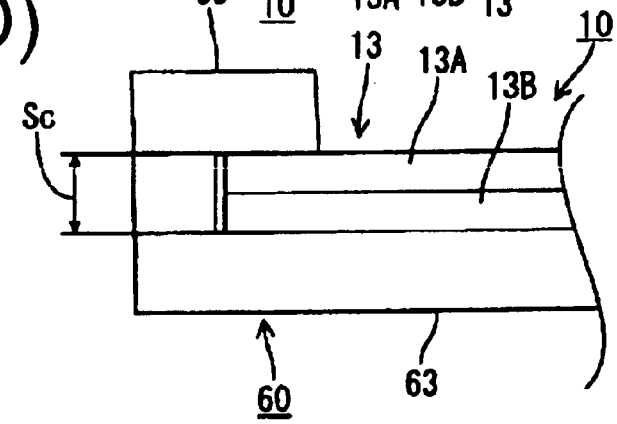

The wire crimping portion 17 has a bottom plate 17C that is substantially continuous and flush with the coupling 16, as shown in FIGS. 3 and 4. Crimping pieces 17A, 17B stand up from left and right edges of the bottom plate 17C. The crimping pieces 17A are formed to be crimped, bent or folded into connection with a metal core of a wire W (see FIG. 5), and the crimping pieces 17B are formed to be crimped, bent or folded into connection with the resin insulation of the wire W. As shown in FIG. 5, the crimping pieces 17A, 17B are crimped and deformed plastically to wrap the wire W placed on the bottom plate 17C so that the wire W is connected with the wire crimping portion 17. Thus, the crimping pieces 17A and the bottom plate 17C are attached closely to the metal core of the wire W to establish an electrical connection. Alternatively or additionally, the wire W may be connected to the grounding terminal 10 by soldering, welding, insulation displacement or the like connection means.

The coupling 16 extends back unitarily from the lower plate 13B, and the bottom plate 17C of the wire crimping portion 17 extends back unitarily from the coupling 16, as shown in FIGS. 3 and 4. The lower plate 13B, the coupling 16 and the bottom plate 17C are substantially coplanar. As shown in FIG. 3, the coupling 16 is narrower than the diameter of the annular portion 19 of the main body 13. Specifically, a transition 13C extends from the annular portion 19 to the coupling 16 and has a width that is reduced gradually toward the back. The coupling 16 is formed continuously at the back side of the transition 13C. The coupling 16 has a constant width portion 16A adjacent the transition 13C and a reduced width portion 16B adjacent the constant width portion 16A. The wire crimping portion 17 is at the back side of the reduced width portion 16B.

The terminal fitting 10 further includes first reinforcing plates 20 folded up at left and right edges of the coupling 16 and a second reinforcing plate 26 that extends from the upper plate 13A of the main body 13, as shown in FIG. 7. The second reinforcing plate 26 is placed on the coupling 16 by folding the first panel 50A, and is held tightly between the first reinforcing plates 20. Thereafter, the first reinforcing plates 20 are folded onto the second reinforcing plate 26, as shown in FIG. 3. The first reinforcing plates 20 are folded at the left and right edges of at least the front half of the constant width portion 16A of the coupling 16. Thus, the second reinforcing plate 26 is pressed by the first reinforcing plates 20 and is prevented from being spaced apart from the coupling 16. As a result, the second reinforcing plate 26 is fixed stably on the top surface of the coupling 16. The first reinforcing plates 20 are formed over at least half the area of the constant width portion 16A along forward and backward directions. Thus, the strength of the base end of the coupling 16 is enhanced where stress is likely to concentrate. Alternatively, the first reinforcing plates 20 may be formed in most or all of the constant width portion 16A along forward and backward directions. Additionally, the first reinforcing plates 20 may be formed at the middle or the back side of the constant width portion 16A along forward and backward directions.

Side walls 22 stand up substantially vertically along the left and right edges of the coupling 16. Each side wall 22 has a horizontal edge 22A that is substantially parallel with the top surface of the coupling 16 and an inclined edge 22B that is inclined such that a distance to the top surface of the coupling 16 is gradually reduced toward the front. The horizontal edge 22A is higher than the upper surface of the second reinforcing plate 26. On the other hand, the height of the inclined edge 22B is reduced toward the front, and the front end of the inclined edge 22B is at substantially the same height as the upper surface of the second reinforcing plate 26. The first reinforcing plates 20 are adjacent the front ends of the inclined edges 22B. Further, the horizontal edges 22A extend from a location near the back end of the constant width portion 16A along the entire reduced width portion 16B and to the wire crimping portion 17, as shown in FIG. 3. The inclined edges 22B are formed to extend back from a substantially longitudinal middle area of the constant width portion 16A.

As shown in FIG. 3, the side walls 22 are longer along forward and backward directions than the first reinforcing plates 20. However, the first reinforcing plates 20 may be longer than or about as long as the side walls 22 along forward and backward directions.

As shown in FIG. 4, the side walls 22 are substantially continuous with the folded portions of the first reinforcing plates 20 and with the crimping pieces 17A of the wire crimping portion 17. Thus, local concentration of stress at boundaries between the reinforcing plates 20, 26, the side walls 22 and the crimping pieces 17A is prevented. Accordingly, the boundaries will not bend or abrade and are strong against impacts, loads, etc. Further, as shown in FIG. 3, the left and right side walls 22 and the first reinforcing plates 20 also prevent widthwise movements of the second reinforcing plate 26.

The grounding terminal fitting 10 can be assembled with an assembling-end terminal fitting 30, as shown in FIGS. 1 and 2. The assembling-end terminal fitting 30 is similar to the grounding terminal fitting 10 and has a substantially flat main body 33 corresponding to the main body 13. Locks 45 that correspond to the locks 15 stand up from the outer peripheral edge of the main body 33 by a distance substantially equal to the thickness of the main body 33.

In this assembled state, the bottom surface of the main body 13 of the grounding terminal fitting 10 is held in substantially close contact with the top surface of the assembling-end terminal fitting 30, and the assembling-end terminal fitting 30 can be attached to an unillustrated mount member for grounding. The mount member may have an internally threaded hole in an electrically conductive member. The grounding terminal fitting 10 can be fixed to the mount member for grounding by inserting a bolt through the bolt hole 12 of the grounding terminal fitting 10 and engaging the bolt with the threaded hole.

The two grounding terminal fittings 10, 30 are assembled by placing the main body 13 of the grounding terminal fitting 10 on the terminal main body 33 of the assembling-end terminal fitting 30 with the bolt holes 12, 32 aligned. The grounding terminal fitting 10 then is rotated in plan view so that at least one engaging portion 23 (see also FIGS. 3 and 4) of the grounding terminal fitting 10 slips between the main body 33 and the lock 45 of the assembling-end terminal fitting 30. Additionally, a rotation preventing piece 34A of the assembling-end terminal fitting 30 engages the rotation preventing hole 14B of the grounding terminal fitting 10. Thus, the terminal fittings 10, 30 are vertically inseparable and have their relative movements in a rotating direction prevented.

In this state, the bolt holes 12, 32 are substantially aligned to permit the insertion of a bolt through the bolt holes 12, 32 as shown in FIG. 1. Further, the wire crimping portions 17, 37 are displaced circumferentially so as not to interfere with each other. The grounding terminal fittings 10, 30 thus assembled can be fixed to the mount member for grounding (not shown) by the unillustrated bolt.

As shown conceptually in FIG. 6(*a*), the main body 13 has a thickness Tb defined by a sum of the thicknesses of the upper and lower plates 13A, 13B. The thickness Tb substantially equals a spacing Sa between the front surface of the main body 30 and the locks 45. Thus, a peripheral portion of the main body 13 is held between the front surface of the main body 30 and the locks 45 to restrict relative vertical movements of the main body 13. The grounding terminal fitting 10 and the assembling-end terminal fitting 30 are of substantially the same shape. Therefore, the layered structure may be reversed so that the terminal main body 33 is held between the front surface of the terminal main body 13 and the locks 15 as shown in FIG. 6(*b*).

The grounding terminal 10 also can be assembled with a thicker grounding terminal fitting 60 as shown in FIG. 6(*c*). The grounding terminal 60 has a main body 63 made of a single plate with a thickness Tc about twice as large as the thickness Ta (see FIG. 6(*a*)) of the grounding terminal fitting 10 or 30. Additionally, the thickness Tc substantially equals a space Sb between the front surface of the main body 13 and the locks 15. The main body, the locks, the wire crimping portion and the like of the grounding terminal 60 can be similar to those of the grounding terminal fittings 10, 30.

The grounding terminal fitting 10 also may be assembled so that the main body 13 is held between the main body 63 of the thicker grounding terminal fitting 60 and the locks 65 as shown in FIG. 6(*d*). The thickness Ta of the grounding terminal fitting 10 is less than the a thickness Tc of the thicker grounding terminal fitting 60 so that the crimping pieces 17A of the wire crimping portion 17 are crimped securely into connection with a thinner wire W to achieve a contact reliability. To compensate for this dimensional difference, the metallic plate material is folded in two to double the thickness of the main body 13 to correspond to the spacing Sc between the main body 63 and the locks 65. In this way, the grounding terminal fitting 30 and the thicker grounding terminal fitting 60 both can be assembled with the common grounding terminal fitting 10.

Figure 8:
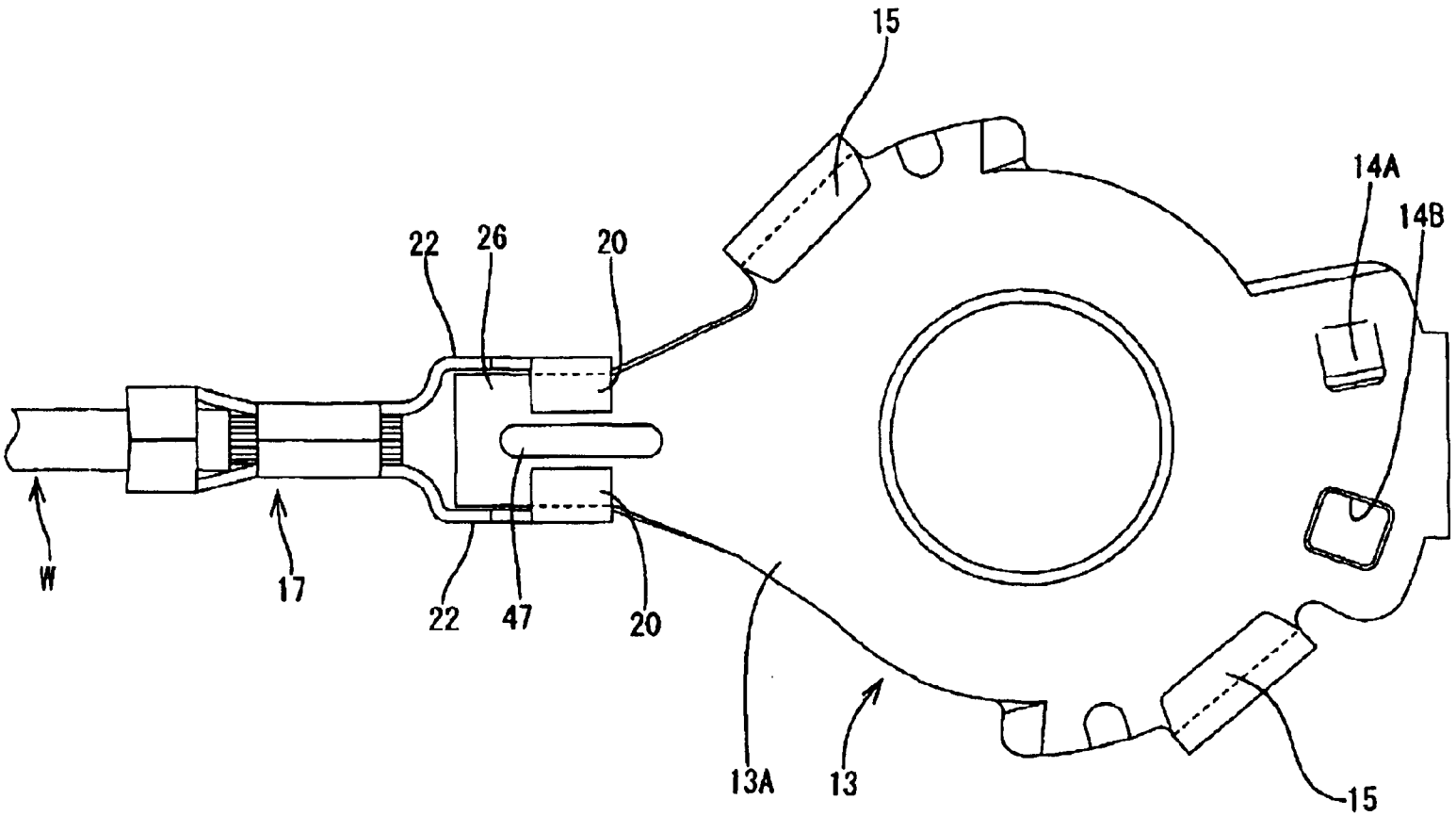
FIG. 8 is a plan view showing a grounding terminal fitting of a second embodiment.
Figure 9A:
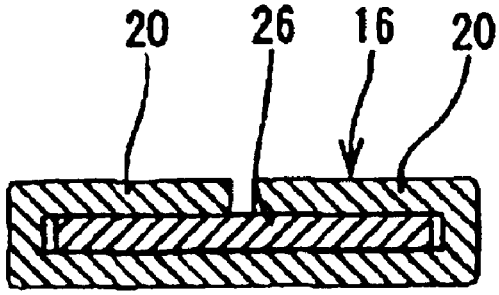
FIGS. 9(*a*) through 9(*d*) show reinforcements by a reinforcing plate.
Figure 9B:
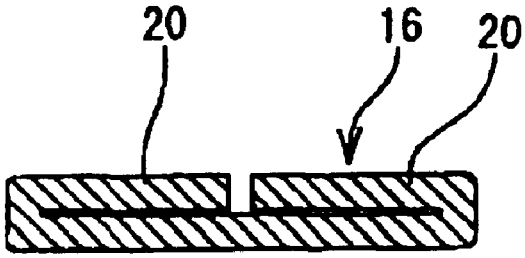
Figure 9C:
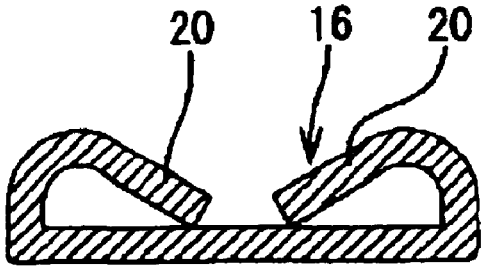
Figure 9D:
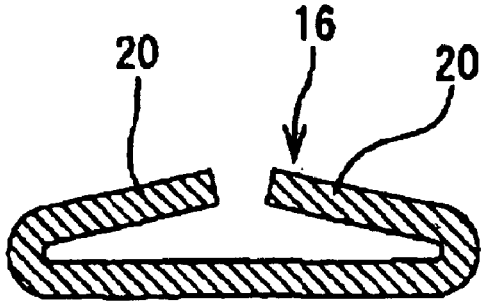
Figure 10:
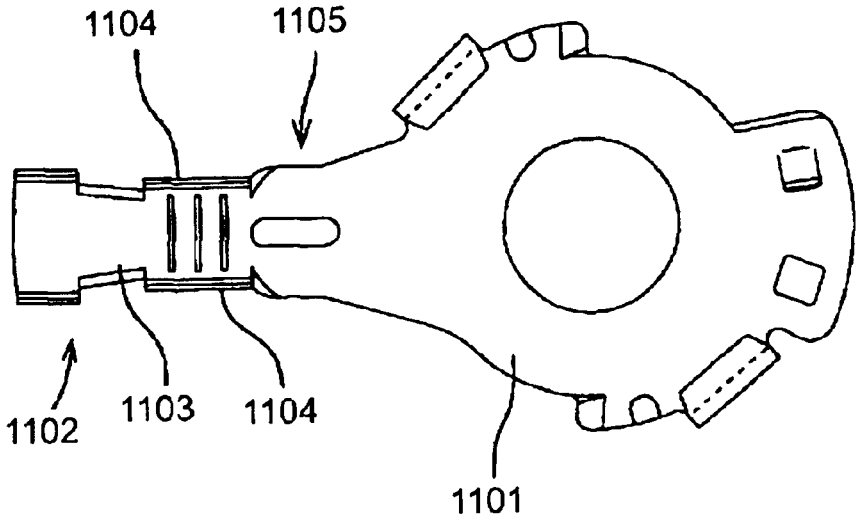
FIG. 10 PRIOR ART
FIG. 10 is a plan view of a prior art grounding terminal fitting.

A second embodiment of the invention is illustrated in FIG. 8. The second embodiment differs from the first embodiment in that at least one narrow reinforcing rib 47 is embossed to extend substantially along the extending direction of the coupling 16. Features of the second embodiment that are similar to the first embodiment are not described, but rather merely are identified by the same reference numeral. These similar features are not described again, but rather are identified by the same reference numerals FIG. 8 shows an example in which the second reinforcing plate 26 is embossed to cause the reinforcing rib 47 to project to the top. The first reinforcing plates 20 are arranged at substantially opposite sides of the reinforcing rib 47. The form of the reinforcing rib 47 is not limited to the above. Only the coupling portion 16 may be worked or both the second reinforcing plate 26 and the coupling portion 16 may be worked.

Although the reinforcing rib 47 projects to the top in FIG. 8, it may project to the bottom. Further, the first reinforcing plates 20 may be worked to form the rib-shaped reinforcing portion. Furthermore, the reinforcing rib may extend up to the main body 13. In any case, the reinforcing rib 47 provides enhanced resistance to deformation and bending in the coupling 16.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

First and second reinforcing plates 20 and 26 are shown in FIG. 9(*a*). However, only one type of the reinforcing plate may be used. In other words, only the first reinforcing plates 20 may be placed on the top surface of the coupling 16 as shown in FIG. 9(*b*) or only the second reinforcing plate 26 may be placed on the top surface of the coupling 16 without providing the first reinforcing plates 20.

The first reinforcing plates 20 are folded closely onto the top surface of the second reinforcing plate 26 or the coupling 16 as shown in FIGS. 9(*a*) and 9(*b*). However, as shown in FIG. 9(*c*), the first reinforcing plates 20 may be curved inwardly with a specified curvature. Alternatively, the first reinforcing plates 20 may be folded such that an angle between the first reinforcing plates 20 and the coupling 16 is a specified acute angle as shown in FIG. 9(*d*). The first reinforcing plates 20 are not limited to the above examples. The first reinforcing plates 20 may take any form so long as they are held vertically in close contact with the coupling 16 or overlap the coupling 16 while defining a specified space therebetween.

Although the first reinforcing plates are folded at the top side in the above examples, they may be folded at the bottom side.

The second reinforcing plate is placed on the top side in the above examples, but it may be placed on the bottom side. For example, the first panel 50A shown in FIG. 7 may be folded at the bottom side.

The first panel 50A shown in FIG. 7 is folded in the above examples. However, another member having a shape similar to the first panel 50A may be placed on the top or bottom surface of the main body 13.

Two grounding terminal fittings are assembled in the above examples. However, three or more grounding terminal fittings can be assembled successively according to the invention. In such a case, the grounding terminal fittings having different thicknesses as shown in FIG. 6 can be assembled in an arbitrary order.

The double-layered assembling-end terminal fitting 30 with the same shape as the grounding terminal fitting 10 and the single-layered thick terminal fitting are assembled with the grounding terminal fitting 10 in the above examples. However, the assembling-end terminal fittings are not limited to the above and the grounding terminal fitting 10 can be assembled with grounding terminal fittings having other shapes. For example, the grounding terminal fitting 10 also can be assembled with a grounding terminal fitting having a multi-layered structure and a main body whose entire thickness is equal to the spacing Sb between the main body 13 and the locks 15 (i.e. equal to the thickness of the main body 13).

A terminal fitting according to a third embodiment is identified by the numeral 110 in FIGS. 11 to 18. The terminal fitting 110 can be mounted on an unillustrated body (e.g. a mount member for grounding, a connection to a supply voltage, etc.) by a bolt, and plural terminal fittings 110, 150 can be assembled one over another in a thickness direction TD. In this embodiment, the terminal fittings 110, 150 have the same construction (see FIG. 11).

Figure 12:
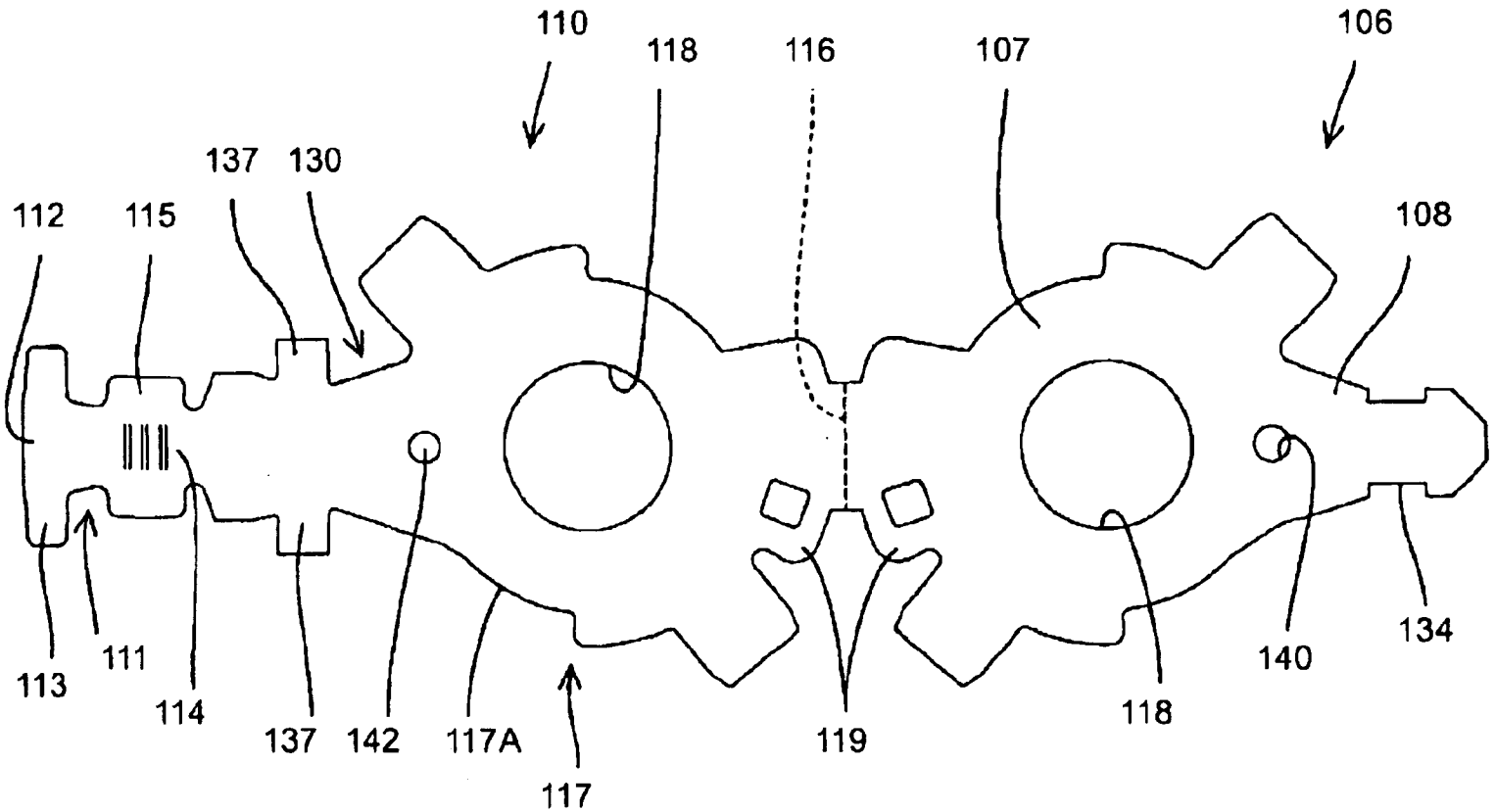
FIG. 12 is a development of the third terminal fitting and a reinforcing plate.
Figure 13:
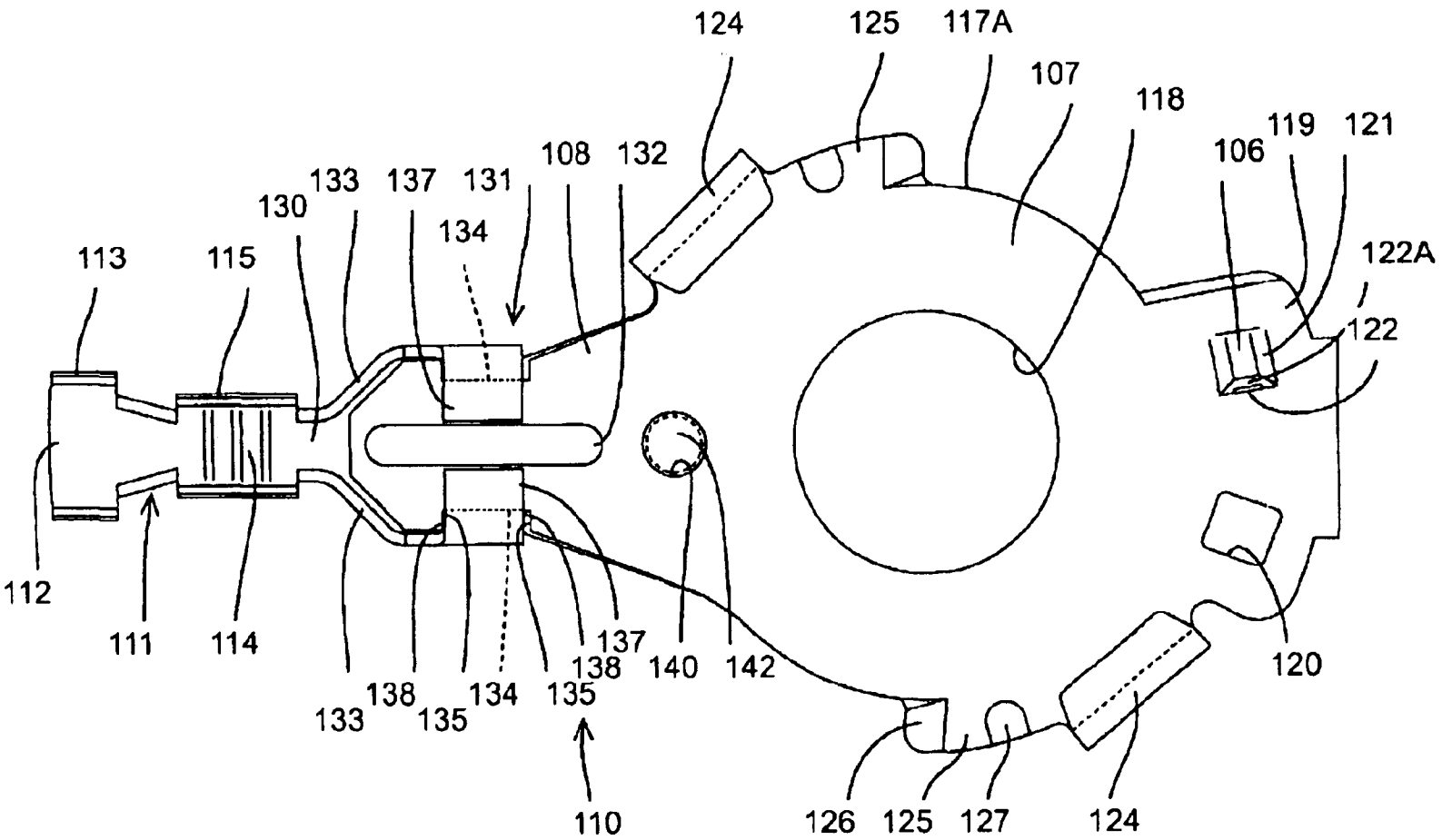
FIG. 13 is a plan view of the third terminal fitting.
Figure 14:
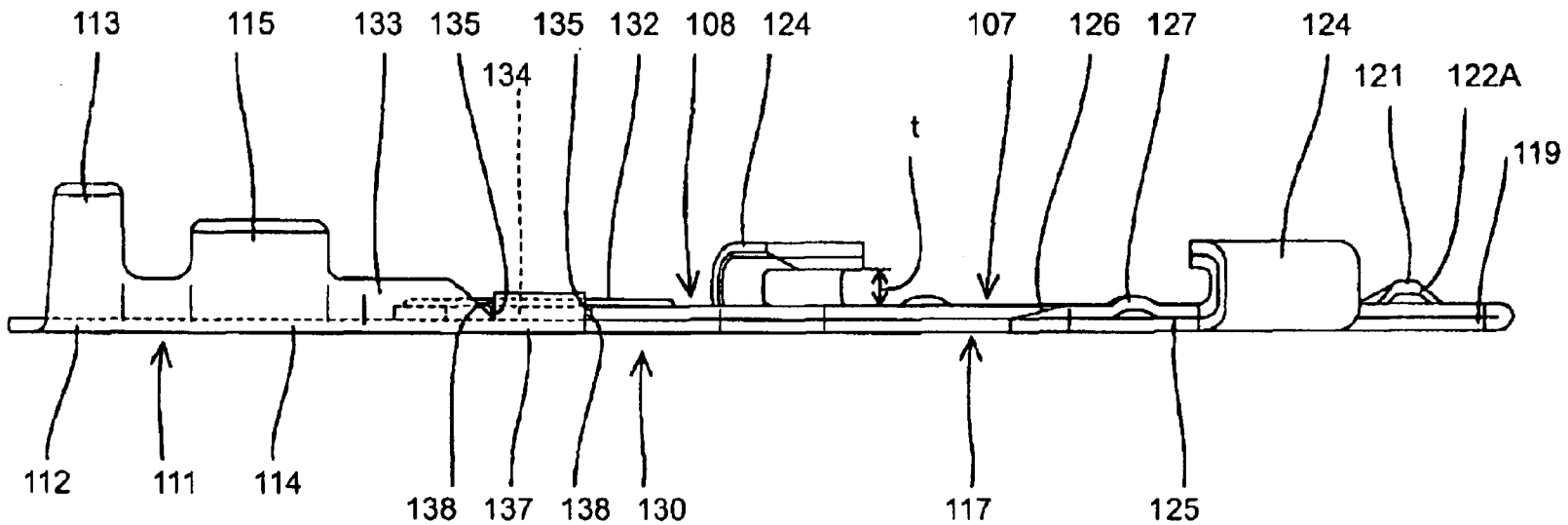
FIG. 14 is a side view of the third terminal fitting.

The first terminal fitting 110 is formed of a conductive metallic plate of substantially uniform thickness and stamped or cut out into a development with a specified shape as shown in FIGS. 12 to 14. As shown in this development, a reinforcing plate 106 is joined unitarily with the terminal fitting 110 along a folding line 116. However, in this embodiment, when the reinforcing plate 106 is folded along the folding line 116 to be placed on the terminal fitting 110, there are two parts: a multi-layered part where the reinforcing plate 106 and the terminal fitting 110 are placed substantially one over the other and a single-layered part where the terminal fitting 110 bulges out from the reinforcing plate 106.

The single-layered part of the first terminal fitting 110 defines a wire crimping portion 111, as shown in FIGS. 13 and 14. The wire crimping portion includes an insulation barrel 112 with two crimping pieces 113 to be crimped, bent or folded into connection with insulation coating 102 of a wire 101. The wire crimping portion 111 also has a wire barrel 114 with two crimping pieces 115 to be crimped, bent or folded into connection with a core 103 of the wire 101.

The multi-layered part of the first terminal fitting 110 includes a main body 117 and a coupling 130. Specifically, the reinforcing plate 106 aligns with the main body 117 and the coupling 130 when folded along the folding line 116. In the following description, a portion of the reinforcing plate 106 on the main body 117 is referred to as a main reinforcement 107 and a portion on the coupling 130 is referred to as a coupling reinforcement 108.

A side on which the reinforcing plate 106 is to be placed (upper side in FIG. 14) is referred to as the upper side and a side opposite therefrom is referred to as the lower side for the sake of convenience.

As shown in FIGS. 13 and 14, the main body 117 and the main reinforcement 107 are formed with annular portions 117A and bolt holes 118. The bolt holes 118 align with each other, and the annular portions 117A have arcuate outer peripheral edges that are substantially concentric with the bolt holes 118. Both annular portions 117A have bulges 119 and are substantially continuous with each other at the folding line 116.

Pressing pieces 124 are formed on the outer peripheral edges of the main body 117 and the main reinforcement 107 at a first position circumferentially adjacent the bulges 119 and at a second position diametrically opposite from the first position. Slipping pieces 125 bulge out radially positions circumferentially spaced from the respective pressing pieces 124.

A slanted guide surface 126 is formed at the front end of the main reinforcement 107 and forms the upper surface of each slipping piece 125 with respect to the clockwise direction in FIG. 13. Further, press-in portions 127 are embossed to project up in a curved manner from the upper surfaces of the slipping pieces 125.

The respective pressing pieces 124 of the main body 117 and the main reinforcement 107 stand up and are held in close contact, and the leading ends of the pressing pieces 124 are bent radially inward and are held in close contact. Thus, the pressing pieces 124 have an inverted L-shape.

Figure 11:
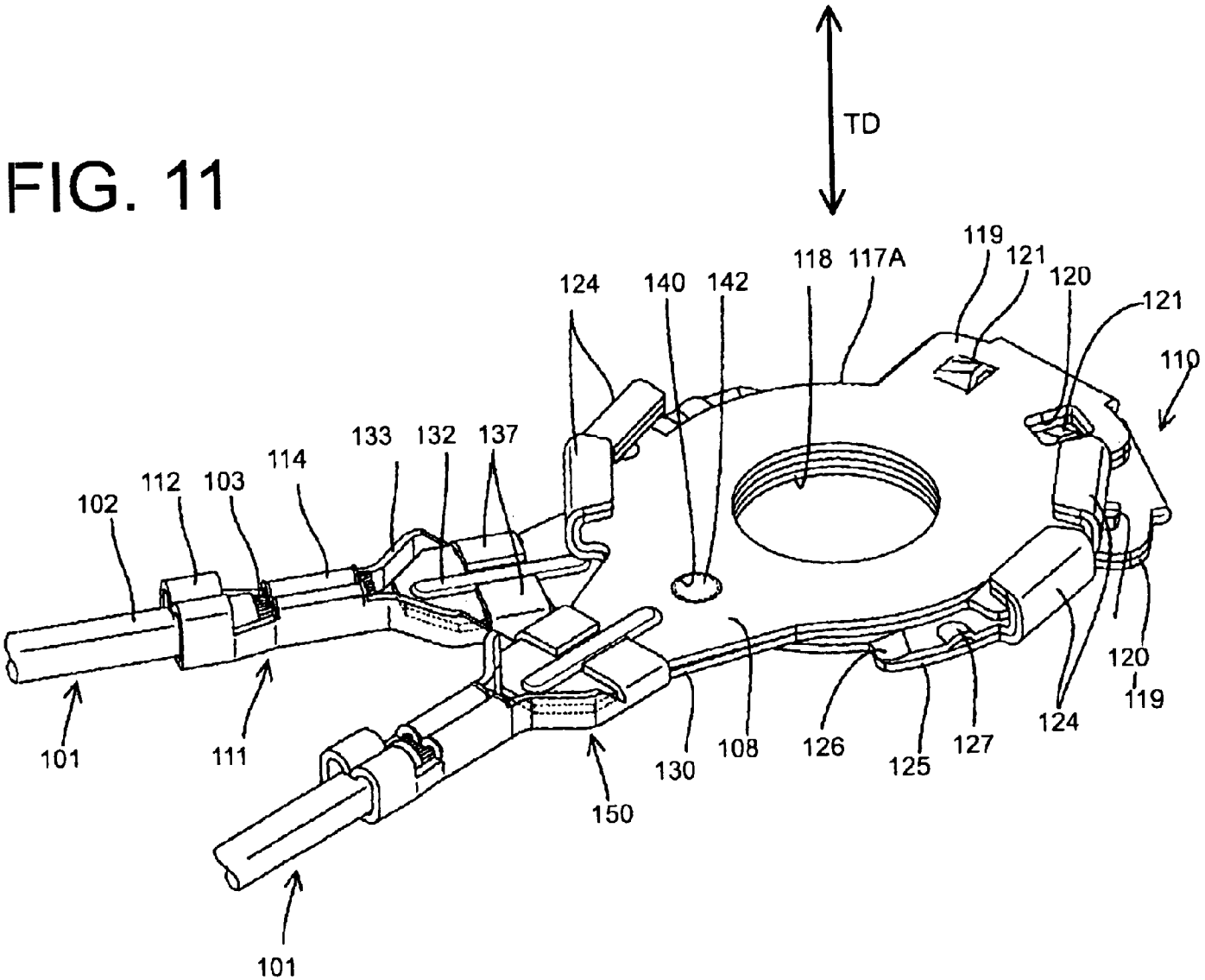
FIG. 11 is a perspective view showing an assembled state of terminal fittings according to a third embodiment of the invention.
Figure 18:
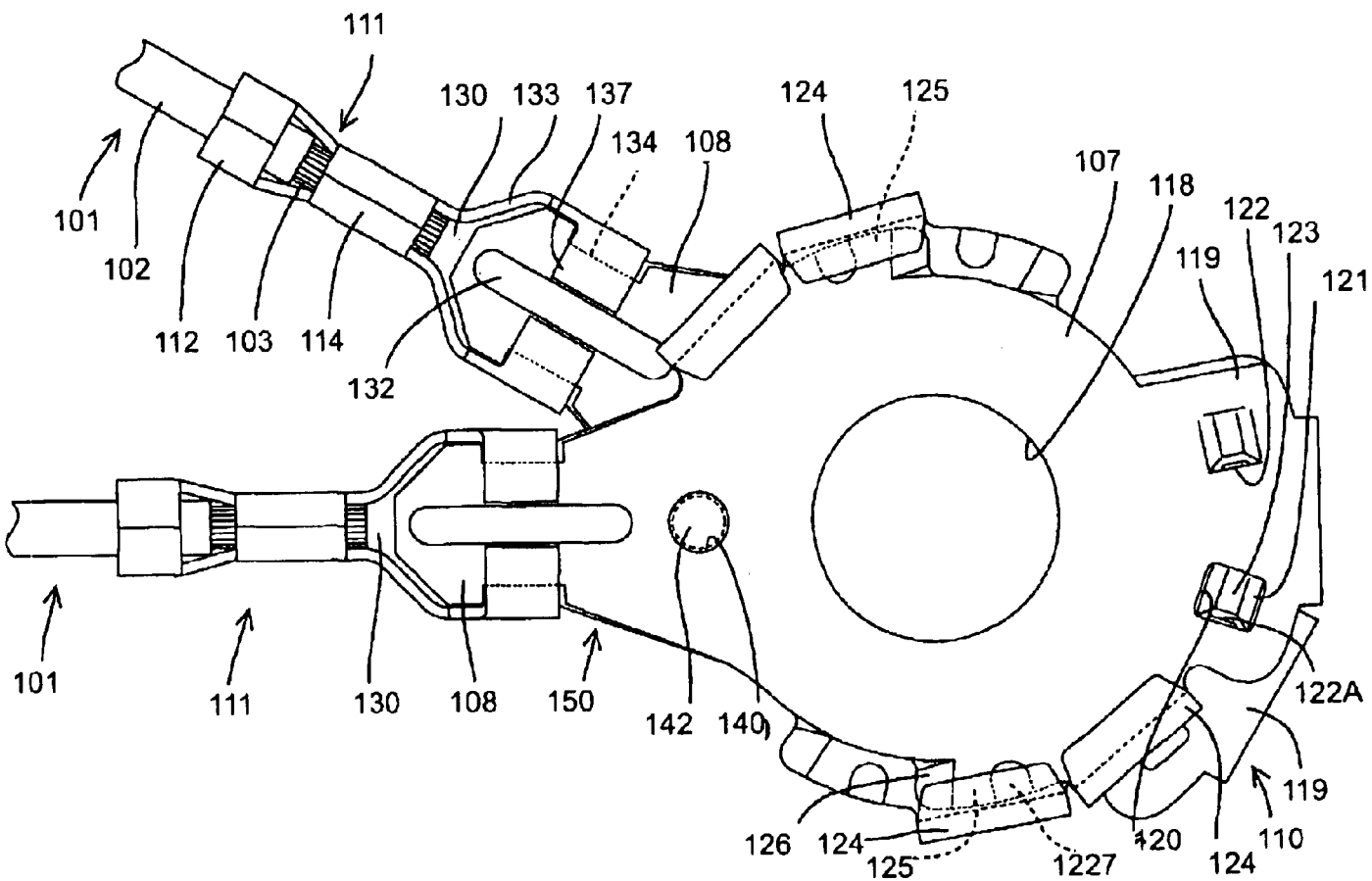
FIG. 18 is a plan view showing an assembled state of terminal fittings.

The slipping pieces 125 of the second terminal fitting 150 can be slipped into the inner spaces of the respective pressing pieces 124 to assemble the firs and second terminal fittings 110 and 150 (see FIGS. 11 and 18). Specifically, the height "t" (see FIG. 14) of the inner space of the pressing piece 124 substantially equals the total thickness of the main body 117 and the main reinforcement 107. The press-in portions 127 that project from the slipping pieces 125 slip into the inner spaces of the pressing pieces 124 and push up the pressing pieces 124 due to the height of the press-in portions 127.

The coupling 130 and the coupling reinforcement 108 are narrower than the main body 117, as shown in FIGS. 12 and 13, and extend between the wire crimping portion 111 and the main body 117. Part of the coupling 130 toward the main body 117 gradually narrows from the main body 117 to a specified position toward the extending end. A straight portion 131 with a substantially constant width extends from the specified position. The coupling 130 narrows gradually from the end of the straight portion 131 to the wire crimping portion 111.

Stress concentrates in the coupling 130 because the coupling is narrower than the main body 117. Accordingly, several kinds of reinforcing means are provided for the coupling 130.

First, the coupling reinforcement 108 is placed on the upper surface of the coupling 130, and ribs 132 are embossed in the widthwise middle of the coupling 130 and the coupling reinforcement 108. The ribs 132 align with each other along the longitudinal direction. In this way, the coupling is reinforced so as not to bend along the longitudinal direction.

Further, reinforcing walls 133 stand up substantially vertically along the opposite widthwise edges of the coupling reinforcement 108 at an end of the straight portion 131 of the coupling 130 substantially continuous with the wire crimping portion 111. The reinforcing walls 133 are continuous with the crimping pieces 115 of the wire barrel 114 and provide reinforcement at and near a boundary between the coupling 130 and the wire crimping portion 111.

The reinforcing plate 106 is placed on the coupling 130 and the main body 117 to form a multi-layered structure. Thus, displacement preventing means is provided for preventing displacements of the reinforcing plate 106 with respect to the coupling 130 and the main body 117.

Two cuts 134 are formed at substantially opposite widthwise edges of the straight portion 131 of the coupling reinforcement 108. Edges 135 of the cuts 134 substantially face each other along the longitudinal direction and extend substantially normal to the longitudinal direction. Two fasteners 137 bulge out sideways like strips from the opposite lateral edges of the straight portion 131 of the coupling 130 at positions corresponding to the cuts 134. The fasteners 137 are bent to stand up along the lateral edges of the straight portion 131 of the coupling reinforcement 108 and leading ends of the fasteners 137 are bent in to be fastened to the upper surface of the coupling reinforcement 108. The leading ends of both fasteners 137 are at the opposite sides of the ribs 132 so as not to overlap the ribs 132.

Figure 15:
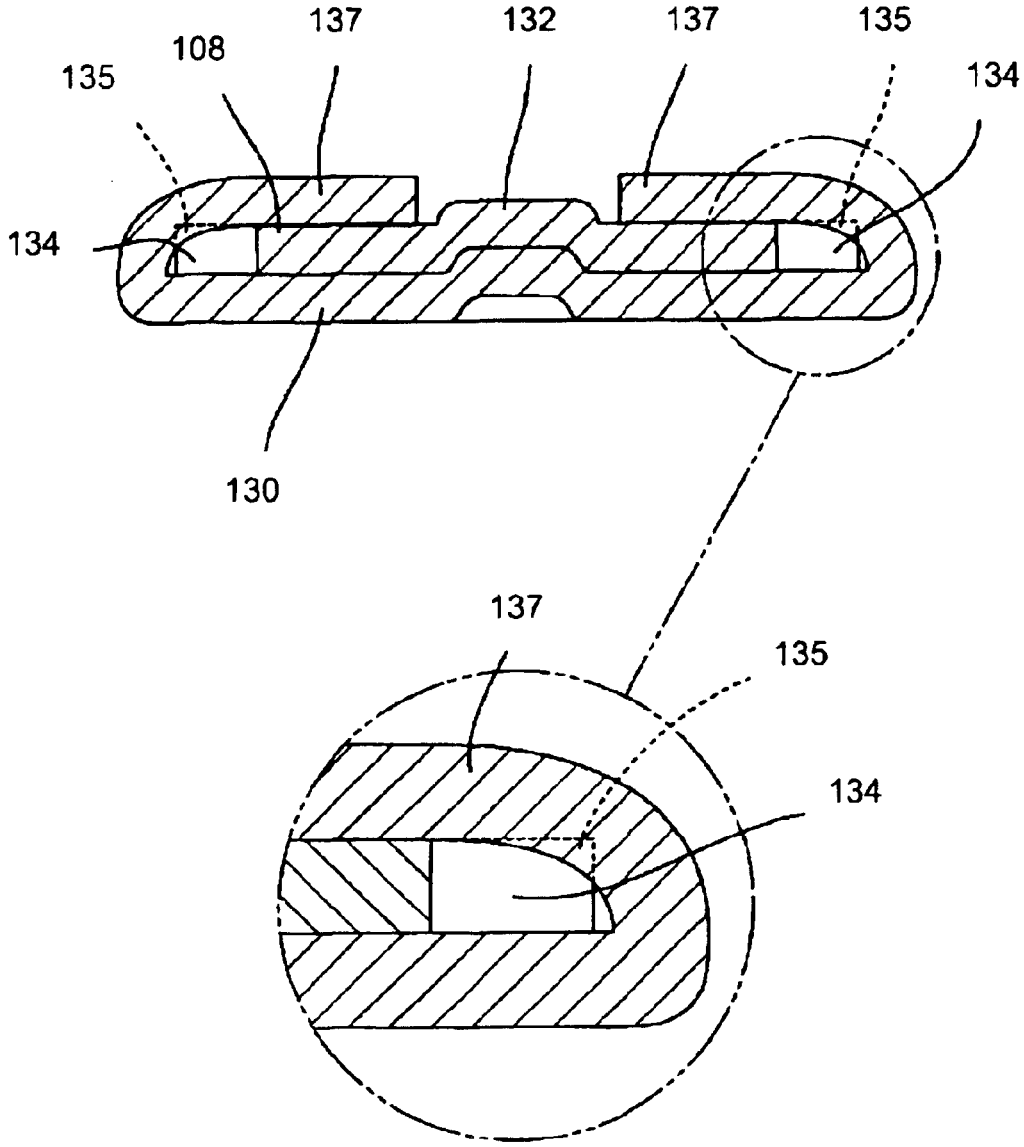
FIG. 15 is a diagram showing cuts and fasteners.

In this fastened state, edges 138 of the inwardly bent sections of the fasteners 137 facing each other along the longitudinal direction are in the cuts 134 and contact the opposite edges 135 of the cuts 134, as shown in FIGS. 13 to 15. Accordingly, the edges 138 of the fasteners 137 and the edges 135 of the cuts 134 are held in contact along the direction substantially normal to longitudinal direction. Thus, displacements of the coupling 130 and the coupling reinforcement 108 along the longitudinal direction are prevented. Further, the portions fastened by the fasteners 137 define a multi-layered structure of the coupling 130, the coupling reinforcement 108 and the fasteners 137. Therefore, the fasteners 137 also enhance the strength of the coupling part.

An engaging projection 142 is near a boundary between the coupling 130 and the main body 117, as shown in FIG. 13. An engaging hole 140 is at a boundary between the coupling reinforcement 108 and the main reinforcement 107 and corresponds to the engaging projection 142. The engaging hole 140 is engageable with the engaging projection 142 when the reinforcing plate 106 is folded. The engaging projection 142 and the engaging hole 140 also form the displacement preventing means.

Figure 16A:
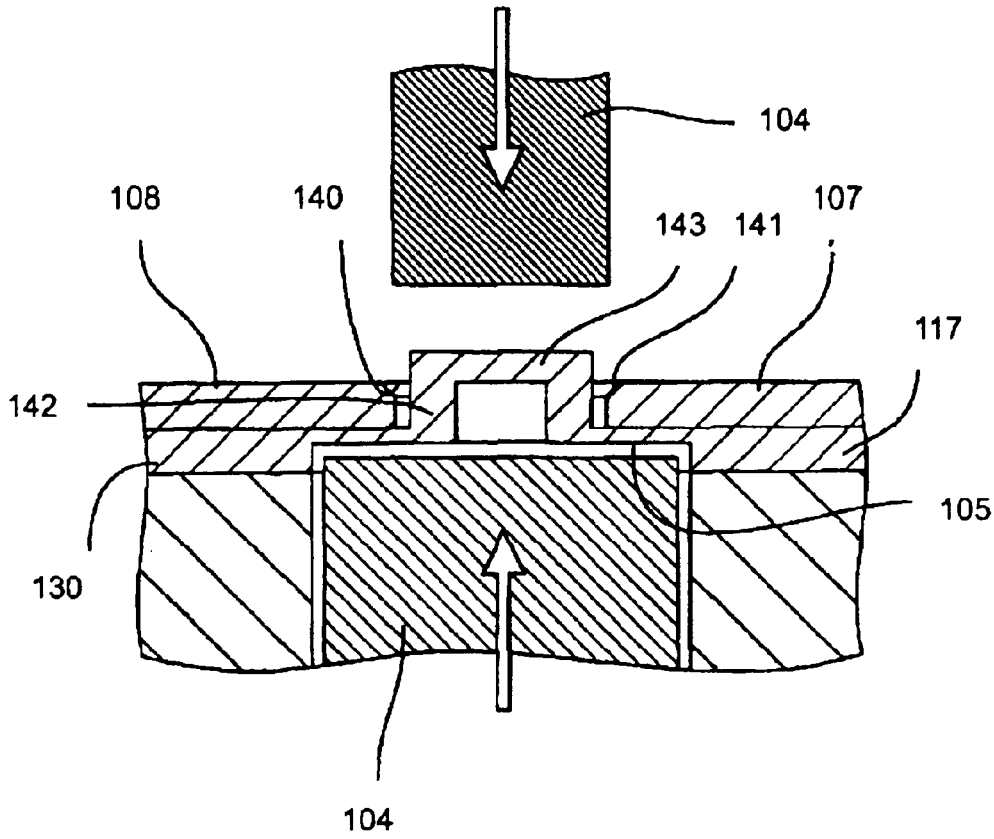
FIGS. 16(A) and 16(B) show an engaging projection and engaging hole.
Figure 16B:
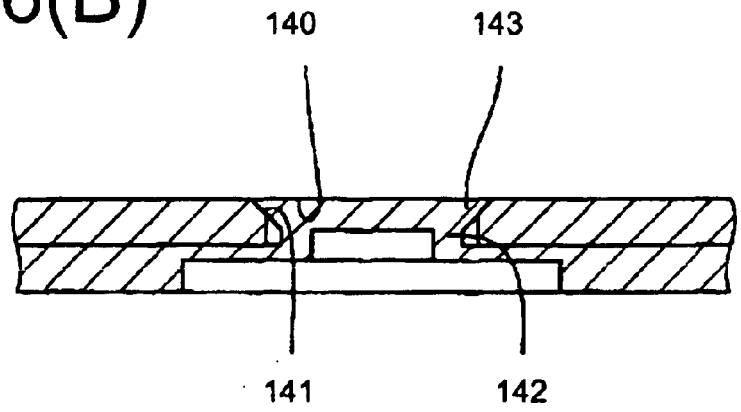
Figure 17:
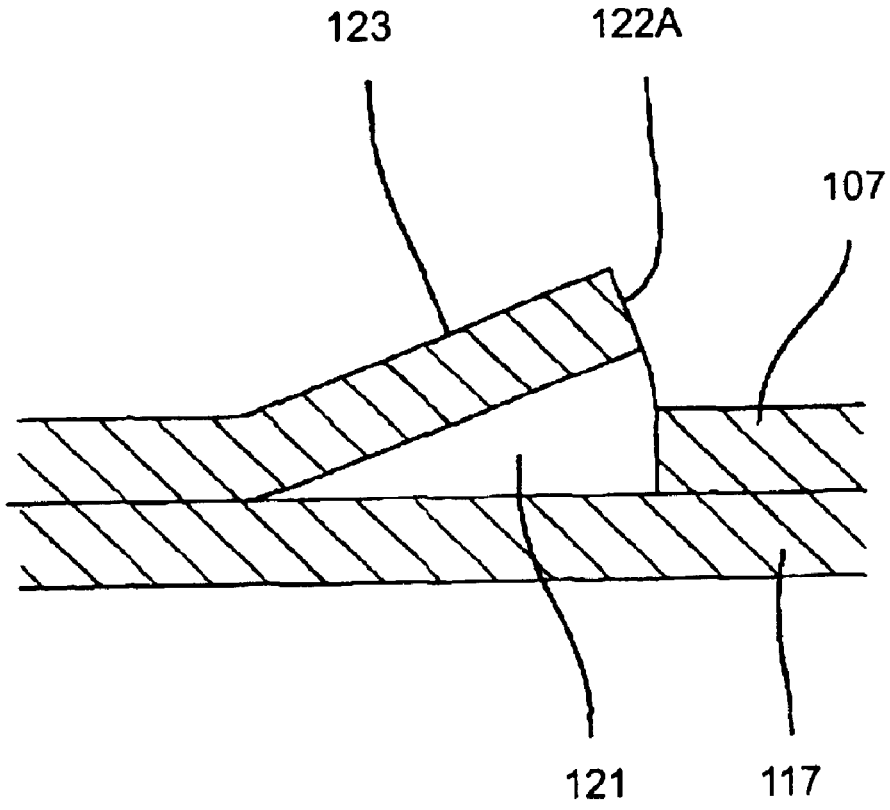
FIG. 17 is an enlarged section of a return preventing projection.

As shown in FIG. 16, the engaging projection 142 is embossed to project up. A projecting height of the engaging projection 142 exceeds the depth of the engaging hole 140, so that the engaging projection 142 projects out from the engaging hole 140.

The upper end of the engaging projection 142 projects out from the engaging hole 140 and is pressed in the thickness direction TD by a crimper 104 as shown in FIG. 16. Thus, the press-deformed portion 143 of the engaging projection 142 is pressed into close contact with an opening edge 141 of the engaging hole 140. Accordingly, the press-deformed portion 143 of the engaging projection 142 and the opening edge 141 of the engaging hole 140 are held in close contact while facing in the thickness direction TD. Thus, the engaging projection 142 cannot come out of the engaging hole 140 and the reinforcing plate 106 cannot separate from the coupling 130 and the main body 117 in the thickness direction TD. Further, the engagement of the engaging hole 140 and the engaging projection 142 prevent the two plates from displacement in planar directions. A device contact recess 105 is formed in the lower surfaces of the coupling 130 and the main body 117 around the engaging projection 142 to press the engaging projection 142.

Wires 101 are connected with the terminal fittings 110, 150 by crimping. Alternatively or additionally, the wires 101 may be connected by soldering, welding, insulation displacement or the like. Subsequently, the terminal fitting 150 is placed on the upper surface of the terminal fitting 110 with both bolt holes 118 aligned. The terminal fittings 110, 150 are arranged in an initial assembling position so that the slipping pieces 125 of the terminal fitting 150 are behind the pressing pieces 124 of the terminal fitting 110. The terminal fitting 150 then is turned circumferentially. Thus, the guide surfaces 126 guide the slipping pieces 125 of the terminal fitting 150 into the inner spaces of the pressing pieces 124 of the terminal fitting 110. As a result, the terminal fittings 110, 150 are made mutually rotated toward a proper assembling position (shown in FIGS. 11 and 18) with the bolt holes 118 aligned.

The terminal fittings 110, 150 are prevented from rotating in a returning direction from the proper assembling position toward the initial assembling position by return preventing means in the bulges 119 of the terminal fittings 110, 150. Specifically, each bulge 119 has a return preventing projection 121 and a return preventing hole 120 as the return preventing means. The return preventing hole 120 is a substantially rectangular through hole near a first circumferential end of the bulge 119.

The return preventing projection 121 is formed by making a cut 122 in a portion of the main reinforcement 107 near the second circumferential end of the bulge 119. The bulge 119 then is embossed up adjacent the cut 122 to define a substantially rectangular return preventing projection 121 that is engageable with the return preventing hole 120. The cut 122 is at a front side of the return preventing projection 121 with respect to the circumferential direction and is separated from the bulge 119. However, the other three sides are coupled to the bulge 119. An projecting edge 122A of the cut 122 of the return preventing projection 121 extends substantially vertically and is engageable with the return preventing hole 120. A guide surface 123 slopes up on the side of the return preventing projection 121 opposite the cut 122 to the projecting edge 122A.

The terminal fittings 110, 150 can be rotated with respect to each other toward the proper assembling position. As a result, the lower surface of the terminal fitting 150 slides on the upper surface of the terminal fitting 110 and moves onto the guide surface 123 of the return preventing projection 121 of the terminal fitting 110. The slipping pieces 125 of the terminal fitting 150 completely enter the inner spaces of the pressing pieces 124 of the terminal fitting 110 when the terminal fittings 110, 150 are rotated to the proper assembling position. Thus, the front ends of the pressing pieces 124 of the terminal fitting 150 contact the rear ends of the pressing pieces 124 of the terminal fitting 110 to prevent further rotation of the terminal fittings 110, 150 from the proper assembling position. Simultaneously, the return preventing hole 120 of the terminal fitting 150 engages the return preventing projection 121 of the terminal fitting 110. Rotation of the terminal fittings 110, 150 toward the initial assembling position is prevented by the engagement of the projecting edge 122A of the return preventing projection 121 with an edge of the return preventing hole 120. Further, the return preventing hole 120 of the terminal fitting 150 engages the return preventing projection 121 of the terminal fitting 110. As a result, the lower surface of the terminal fitting 150 is brought into close contact with the upper surface of the terminal fitting 110. The terminal fittings 110, 150 are assembled so that the bolt holes 118 align, the wire crimping portions 111 do not overlap, and both vertical separation and rotation are prevented.

As described above, the main body 117 and the coupling 130 are reinforced by placing the reinforcing plate 106 on the main body 117 and the coupling 130. Further, the two plates are prevented from separating along the thickness direction TD and displacing along the longitudinal direction by the engaging hole 140, the engaging projection 142, the cuts 134 and the fasteners 137. As a result, the coupling part is reinforced by the reinforcing plate 106.

The terminal fittings 110, 150 are prevented from returning in counterclockwise direction opposite from the assembling direction by the engagement of the return preventing projection 121 with the return preventing hole 120. A return preventing projection with a cantilever-shape would have a free end, and opposite sides would be separated from the bulge. Thus, a force could act in a direction to lift or otherwise deform the free end in a manner that would impair a return preventing function. However, the return preventing projection 121 of this embodiment has a cut 122 along only one side. Opposite ends of the cut 122 are connected with the bulge 119. Therefore, a holding force of the return preventing projection is enhanced and the return preventing function is improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The reinforcing plate 106 is continuous with the terminal fitting 110 and is folded onto the terminal fitting 110 in the foregoing embodiment. However, a reinforcing plate may be separate from the terminal fitting 110.

The reinforcing plate 106 is placed substantially on the main body 117 in the foregoing embodiment. However, it may be placed only on the coupling 130.

The reinforcing plate 106 is placed on the upper surface of the terminal fitting 110 in the foregoing embodiment, but it may be placed under the lower surface thereof.

The terminal fitting 150 is identical to the terminal fitting 110 in the foregoing embodiment. However, a terminal fitting having another construction can be assembled with the terminal fitting 110.

Figure 19:
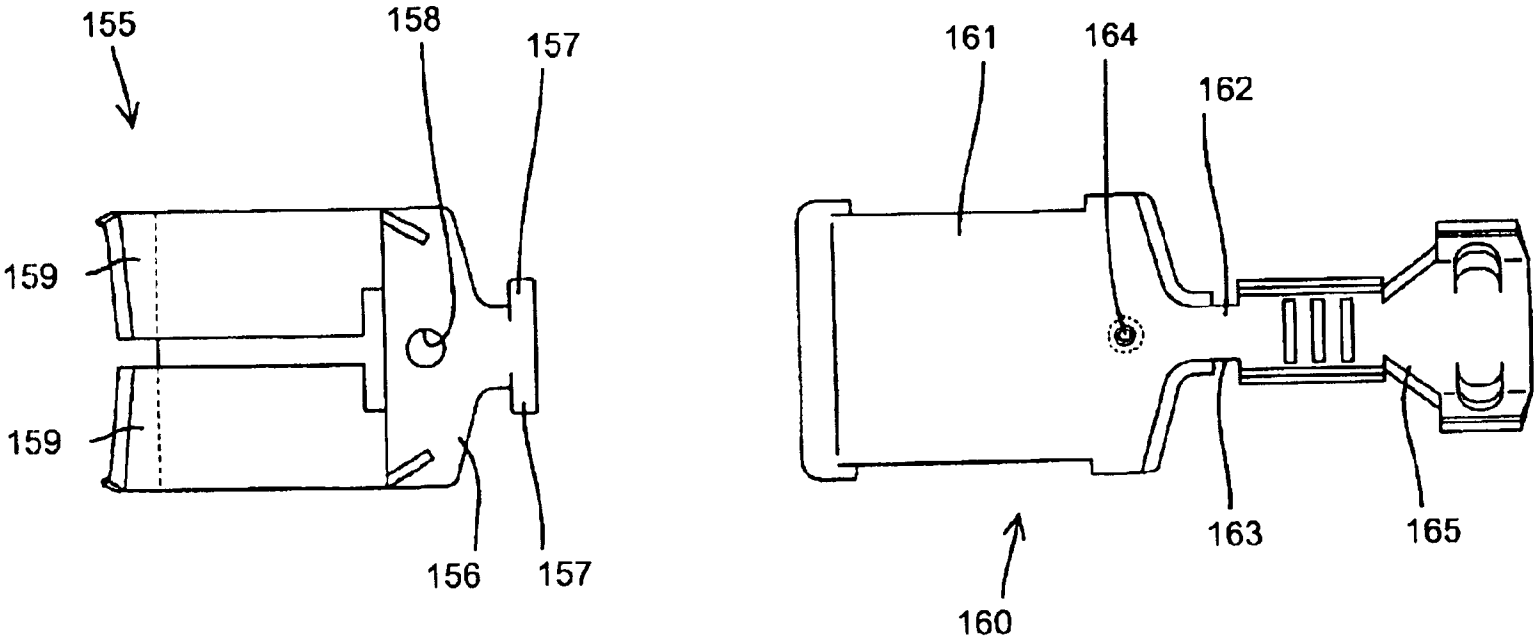
FIG. 19 is an exploded plan view of a terminal fitting according to another embodiment of the invention.
Figure 20:
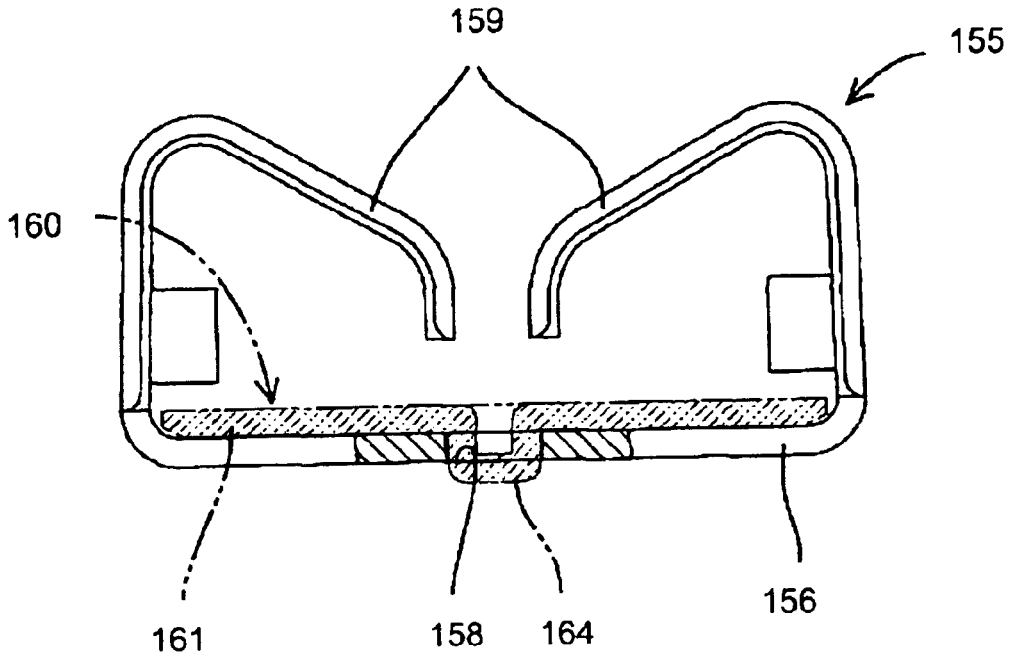
FIG. 20 is a section of a spring.
Figure 21:
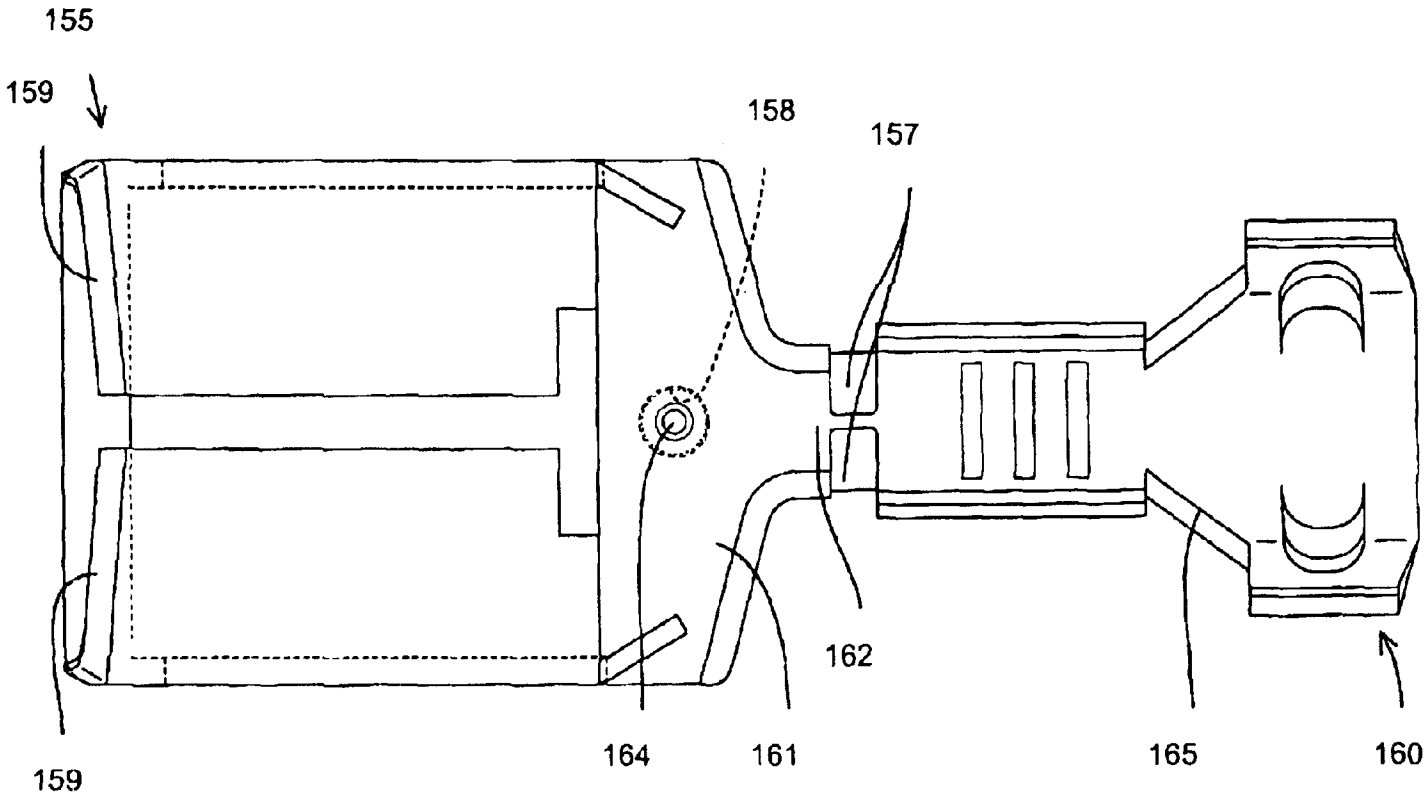
FIG. 21 is a plan view showing a state where the spring and main body are assembled.

The terminal fitting 110 is used, for example, by being mounted on the mount member for grounding and can be assembled with a plurality of terminal fittings in the foregoing embodiment. However, the invention is also applicable to different terminal fittings. For example, the terminal fitting may have a spring 155 and a main body 160, as shown in FIGS. 19 to 21. The spring 155 is formed with two resilient contact pieces 159 that stand up from the opposite widthwise edges of a flat base plate 156 and have leading ends bent in.

The main body 160 has a connecting plate 161, a wire connecting portion 165 and a coupling 162 that extends between the connecting plate 161 and the wire crimping portion 165. The connecting plate 161 is inserted into the spring 155 to be assembled on the base plate 156. In this assembled state, an unillustrated male terminal fitting enters between the resilient contacts 159 and the connecting plate 161 to bring the resilient contacts 159 and the male terminal fittings into contact with each other.

The base plate 156 of the spring 155 is under the lower surface of the coupling 162, and hence reinforces the coupling 162. Fasteners 157 at the base plate 156 are crimped, bent or folded into close contact with the upper surface of the coupling 162. Thus, the coupled part has a triple-layered, structure and a higher strength. Cuts 163 are provided at the opposite widthwise edges of the coupling 162, and displacements of the spring 155 and the main body 160 along the longitudinal direction are prevented by the cuts 163 and the fasteners 157. The connecting plate 161 and the spring 155 are provided with an engaging projection 164 and an engaging hole 158, respectively, and the engaging projection 164 is pressed into close contact with an opening edge of the engaging hole 158. As a result, separation of the connecting plate 161 and the base plate 156 along the thickness direction TD is prevented.

What is claimed is:

1. A grounding terminal fitting made of a unitary conductive plate material stamped out into a specified shape, comprising:

a first panel having a bolt hole form therethrough;

a coupling extending from an outer peripheral edge of the first panel;

a wire connection portion extending from an extending end of the coupling and configured for crimped connection with a wire;

a second panel joined unitarily to the first panel along a fold line and folded into substantially face-to-face engagement with the first panel such that the first and second panels define a main body, the second panel having a bolt hole registered with the bolt hole of the first panel;

a reinforcing plate extending unitarily from the second panel and lying in substantially face-to-face engagement with the coupling that extends from the first panel such that the reinforcing plate is between the main body and the wire connection portion; and at least one fastener folded from the coupling into engagement with a surface of the reinforcing plate facing away from the coupling, whereby the reinforcing plate reinforces the coupling without impeding crimping of the wire connection portion into connection with a wire.

2. The grounding terminal fitting of claim 1, wherein the at least one fastener is folded at lateral edges of the coupling.

3. The grounding terminal fitting of claim 2, wherein the coupling is formed with side walls standing up along lateral edges thereof.

4. The grounding terminal fitting of claim 3, wherein at least one of the side walls and the fastener are substantially continuous with each other along the lateral edges of the coupling.

5. The grounding terminal fitting of claim 4, wherein the wire connection portion is a barrel with a bottom plate substantially continuous with the coupling and crimping pieces standing up from lateral edges of the bottom plate, the crimping pieces and the side walls being substantially continuous with each other along the lateral edges of the coupling.

6. The grounding terminal fitting of claim 1, wherein the coupling is formed with a narrow reinforcing rib extending substantially along an extending direction of the coupling.

7. The grounding terminal fitting of claim 1, wherein the coupling and the reinforcing plate having displacement preventing means engaged with each other for preventing displacements of the coupling and the reinforcing plate along a thickness direction and displacements along directions parallel to facing surfaces thereof.

8. The grounding terminal fitting of claim 7, wherein the displacement preventing means include at least one cut and at least one fastener.

9. The terminal fitting of claim 7, further comprising return preventing means in the main body for holding the terminal fitting assembled with a second terminal fitting.

10. The terminal fitting of claim 9, wherein the return preventing means includes a return preventing hole in one of the terminal fittings and a return preventing projection at the other thereof, each return preventing projection being formed by cutting and bending and opposite ends of a cut side of each return preventing projection being coupled to the main body.

11. A terminal fitting made of a conductive plate material stamped out into a specified shape, comprising:

a main body;

a coupling extending from an outer peripheral edge of the main body;

a wire connection portion extending from an extending end of the coupling;

a reinforcing means formed by folding at least one reinforcing plate so that at least a portion of the reinforcing plate is placed on the coupling; and an engaging hole being formed in one of the coupling and the reinforcing plate in an area where the reinforcing plate is placed on the coupling, an engaging projection formed in the other of the coupling and reinforcing plate and engaged with the engaging hole for preventing displacements of the coupling and the reinforcing plate along a thickness direction and displacements along direction parallel to facing surfaces thereof.

12. The terminal fitting of claim 11, wherein the engaging projection is formed to project to a side where the coupling and the reinforcing plate contact each other and at a position for engaging the engaging hole.

13. The terminal fitting of claim 12, wherein the engaging projection has a height longer than the depth of the engaging hole, a leading end of the engaging projection projecting out from the engaging hole to define a projecting portion pressed into contact with an opening edge of the engaging hole in the thickness direction.

14. A terminal fitting made of a conductive plate material stamped out into a specify shape, comprising:

a main body;

a coupling extending from an outer peripheral edge of the main body;

a wire connection portion extending from an extending end of the coupling;

a reinforcing means formed by folding at least one reinforcing plate so that at least a portion of the reinforcing plate is placed on the coupling, the coupling and the reinforcing plate having displacement preventing means engaged with each other for preventing displacements of the coupling and the reinforcing plate along a thickness direction and displacements along directions parallel to facing surfaces thereof, the displacement preventing means including at least one cut and at least one fastener, wherein the cut is formed by cutting off an edge of one of the coupling and the reinforcing plate and has two edges substantially facing each other along a longitudinal direction.

15. The terminal fitting of claim 14, wherein the fastener is on the other of the coupling and the reinforcing plate and is crimped into contact with a surface adjacent the cut for holding the coupling and the reinforcing plate at a position adjacent the cut, and opposite edges of the fastener contacting the opposite edges of the cut.

16. A terminal fitting assembly, comprising:

a first terminal fitting having a first main body, a coupling extending from an outer peripheral edge of the first main body, and a first wire connection portion extending from an extending end of the coupling, the coupling having reinforcing means formed by folding at least one reinforcing plate, the first main body having a layered structure formed by folding a single plate substantially continuous with the reinforcing plate to have a first thickness, a first lock standing up by a selected distance from the outer peripheral edge of the first main body;

a second terminal fitting having second main body with a second thickness and a second lock standing up from an outer peripheral edge of the second main body by a distance substantially equal to the thickness of the first main body; and the first terminal fitting being assembled with the second terminal filling so that the second main body is held between the first main body and the first lock and the first main body is held between the second main body and the second lock.

17. The terminal fitting of claim 16, wherein the at least one reinforcing plate is folded at lateral edges of the coupling.

18. The terminal fitting of claim 17, wherein the coupling is formed with side walls standing up along lateral edges thereof.

19. The terminal fitting of claim 18, wherein the side walls and the reinforcing plates are substantially continuous with each other along the lateral edges of the coupling.

20. The terminal fitting of claim 19, wherein the wire connection portion is a barrel with a bottom plate substantially continuous with the coupling and crimping pieces standing up from lateral edges of the bottom plate, the crimping pieces and the side walls being substantially continuous with each other along the lateral edges of the coupling.

* * * * *